US011552421B2

(12) United States Patent
Morita et al.

(10) Patent No.: US 11,552,421 B2
(45) Date of Patent: Jan. 10, 2023

(54) ELECTRICAL CONNECTOR WITH FLOATING CONTACTS EACH WITH MULTIPLE IMPEDANCES

(71) Applicant: KYOCERA CORPORATION, Kyoto (JP)

(72) Inventors: Shunsuke Morita, Yokohama (JP); Masayoshi Kakino, Yokohama (JP); Masashi Kakeno, Yokohama (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 17/701,557

(22) Filed: Mar. 22, 2022

(65) Prior Publication Data

US 2022/0216633 A1 Jul. 7, 2022

Related U.S. Application Data

(63) Continuation of application No. 16/346,054, filed as application No. PCT/JP2018/036740 on Oct. 1, 2018, now Pat. No. 11,322,875.

(30) Foreign Application Priority Data

Oct. 25, 2017 (JP) ..... JP2017-206596

(51) Int. Cl.
*H01R 12/91* (2011.01)
*H01R 12/71* (2011.01)
(Continued)

(52) U.S. Cl.
CPC ..... *H01R 12/91* (2013.01); *H01R 12/716* (2013.01); *H01R 12/73* (2013.01); *H01R 13/05* (2013.01);
(Continued)

(58) Field of Classification Search
CPC ..... H01R 12/91; H01R 12/716; H01R 12/73; H01R 13/05; H01R 13/41; H01R 13/6315;
(Continued)

(56) References Cited

U.S. PATENT DOCUMENTS 9,022,811 B2 5/2015 Takaki
9,160,122 B2 10/2015 Sato
(Continued)

FOREIGN PATENT DOCUMENTS

EP 2874238 A1 5/2015
JP 4684789 A 2/2011
(Continued)

*Primary Examiner* — Abdullah A Riyami
*Assistant Examiner* — Justin M Kratt
(74) *Attorney, Agent, or Firm* — Duane Morris LLP

(57) ABSTRACT

A connector (10) according to the present disclosure includes an insulator to be fitted to a connection object (60), and contacts (50) attached to the insulator. Each of the contacts (50) includes a contact portion (59), a first elastic portion (54A), a first adjustment portion (54B1), and a second adjustment portion (54B2). The contact portion (59) electrically contacts the connection object (60) when the insulator and the connection object (60) are fitted together. The first elastic portion (54A) is elastically deformable and extends from a first base (51) supported by the insulator. The first adjustment portion (54B1) is formed continuously with the first elastic portion (54A) and has an electric conductivity higher than that of the first elastic portion (54A). The second adjustment portion (54B2) is formed continuously with the first adjustment portion (54B1) and has an electric conductivity lower than that of the first adjustment portion (54B1).

8 Claims, 15 Drawing Sheets

(51) Int. Cl.

| | |
|---|---|
| ***H01R 12/73*** | (2011.01) |
| ***H01R 13/05*** | (2006.01) |
| ***H01R 13/41*** | (2006.01) |
| ***H01R 13/631*** | (2006.01) |
| ***H01R 13/6474*** | (2011.01) |
| *H01R 12/57* | (2011.01) |

(52) U.S. Cl.
CPC ..... *H01R 13/41* (2013.01); *H01R 13/6315* (2013.01); *H01R 13/6474* (2013.01); *H01R 12/57* (2013.01); *H01R 12/712* (2013.01)

(58) Field of Classification Search
CPC ... H01R 13/6474; H01R 12/57; H01R 12/712
See application file for complete search history.

(56) References Cited

U.S. PATENT DOCUMENTS

| | | | | |
|---|---|---|---|---|
| 2015/0044917 | A1 | 2/2015 | Takaki | |
| 2015/0132976 | A1* | 5/2015 | Sato ..... | H01R 13/2457 439/74 |
| 2015/0132998 | A1 | 5/2015 | Sato | |

FOREIGN PATENT DOCUMENTS

| | | | |
|---|---|---|---|
| JP | 5481594 | B1 | 2/2014 |
| JP | 5568677 | B1 | 6/2014 |
| JP | 2014165084 | A | 9/2014 |
| JP | 2014225469 | A | 12/2014 |

* cited by examiner

ELECTRICAL CONNECTOR WITH FLOATING CONTACTS EACH WITH MULTIPLE IMPEDANCES

CROSS REFERENCE TO RELATED APPLICATION

This application is a continuation of U.S. application Ser. No. 16/346,054, filed on Apr. 29, 2019, which claims priority to and the benefit of Japanese Patent Application No. 2017-206596, filed on Oct. 25, 2017, the entire contents of which are incorporated herein by reference.

TECHNICAL FIELD

The present disclosure relates to a connector and an electronic device.

BACKGROUND

As a technique for improving reliable connectivity to a connection object, connectors having, for example, a floating structure in which a deviation between substrates is accommodated by movement of a portion of the connector during and after fitting is known.

PTL 1 set forth below discloses an electric connector having a floating structure that contributes to miniaturization while inhibiting poor conduction caused by flux oozing.

CITATION LIST

Patent Literature

PTL 1: Japanese Patent No. 5568677

SUMMARY

A connector according to an embodiment of the present disclosure includes an insulator to be fitted to a connection object, and contacts attached to the insulator. Each of the contacts includes: a contact portion configured to electrically contact the connection object when the insulator and the connection object are fitted together; a first elastic portion that is elastically deformable and extends from a first base supported by the insulator; a first adjustment portion that is formed continuously with the first elastic portion and has an electric conductivity higher than that of the first elastic portion; and a second adjustment portion that is formed continuously with the first adjustment portion and has an electric conductivity lower than that of the first adjustment portion.

DETAILED DESCRIPTION

Figure 1:
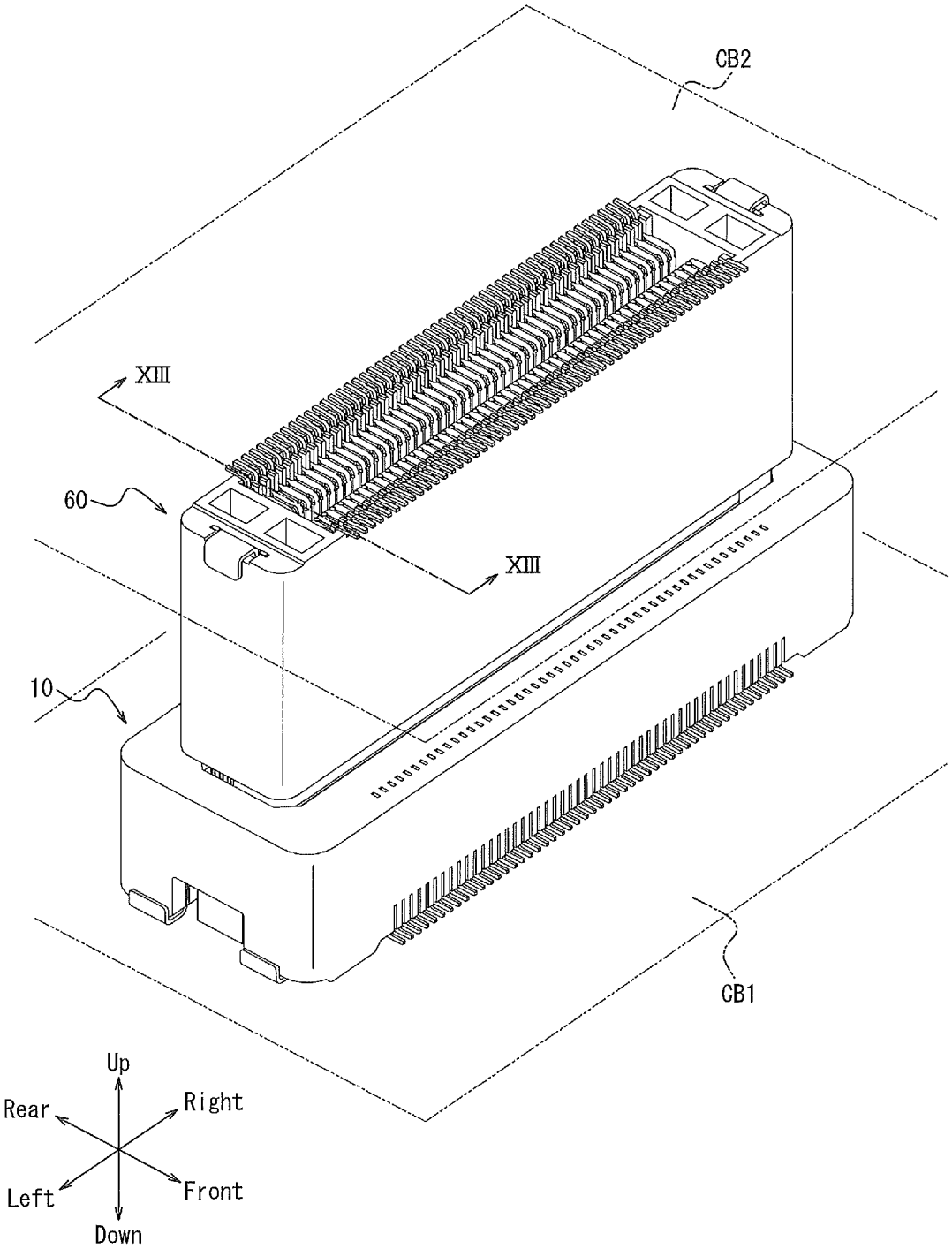
FIG. 1 is an external top perspective view illustrating a state in which a connector according to an embodiment and a connection object are connected to each other.

In recent years, increases in an information amount and a speed of a signal transmission have progressed at a remarkable rate. Connectors having floating structures are desired to support such a large capacity and high speed transmission. However, the electric connector described in the PTL 1 does not sufficiently consider such a design that supports a large capacity and high speed transmission.

A connector according to one embodiment of the present disclosure has excellent transmission characteristics for signal transmission.

Hereinafter, an embodiment of the present disclosure will be described with reference to the accompanying drawings. Terms such as "front-rear direction", "left-right direction", and "up-down direction" used herein correspond to the directions indicated by arrows in the drawings. The directions indicated by the arrows in FIG. 1 to FIG. 9, FIG. 13, and FIG. 16A to FIG. 16D correspond with each other. Similarly, the directions indicated by the arrows in FIG. 14 and FIG. 15 correspond with each other. In some figures, circuit boards CB 1 and CB 2 are omitted for the purpose of simplification.

In the following description, a connector 10 according to the present embodiment is described as a receptacle connector, and a connection object 60 is described as a plug connector. In particular, the connector 10 is the receptacle connector in which contact portions of contacts 50 elastically deform when the connector 10 and the connection object 60 are to be connected, and the connection object 60 is the plug connector in which contacts 90 do not elastically deform. Further variants of the connector 10 and the connection object 60 are not limited to this configuration. The connector 10 and the connection object 60 may function as the plug connector and the receptacle connector, respectively.

In the following description, it is assumed that the connector 10 and the connection object 60 are mounted on the circuit board CB 1 and the circuit board CB 2, respectively, and connected to the circuit boards in a direction perpendicular thereto. The connector 10 and the connection object 60 are connected to each other along the up-down direction, by way of example. The term "fitting direction" used in the following description refers to the up-down direction, by way of example. The manner by which the connector 10 and the connection object 60 are connected to each other is not limited thereto. The connector 10 and the connection object 60 may be connected parallel to the circuit board CB 1 and the circuit board CB 2, respectively. Alternatively, one of the connector 10 and the connection object 60 may be connected perpendicular to the corresponding circuit board while the other is connected in parallel to the corresponding circuit board. The circuit boards CB 1 and CB 2 may be rigid boards or any other circuit boards. For example, the circuit board CB 1 or the circuit board CB 2 may be a flexible printed circuit board (FPC).

Figure 2:
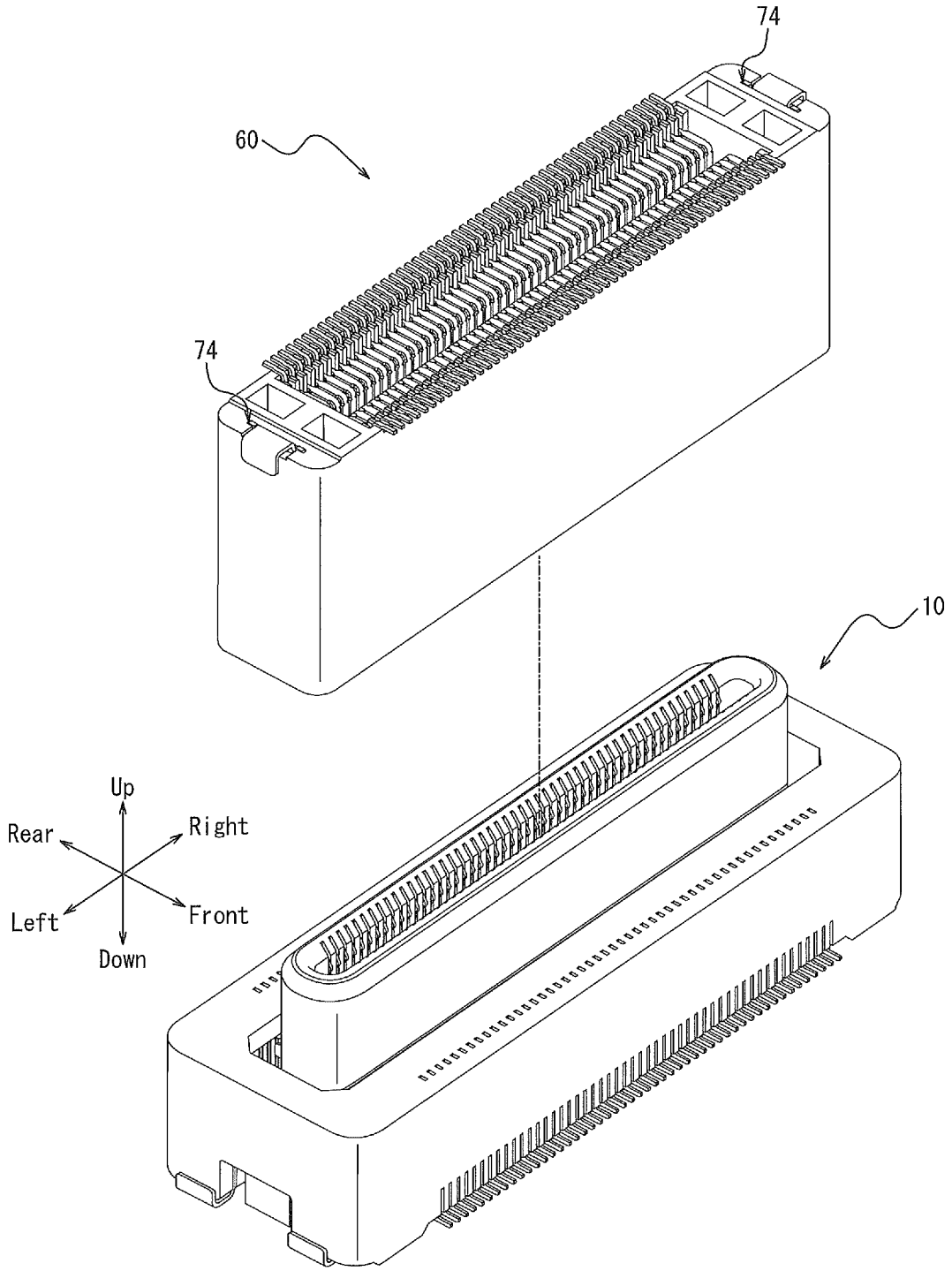
FIG. 2 is an external top perspective view illustrating a state in which the connector according to the embodiment and the connection object are separated from each other.

FIG. 1 is an external top perspective view illustrating a state in which the connector 10 according to an embodiment and the connection object 60 are connected to each other. FIG. 2 is an external top perspective view illustrating a state in which the connector 10 according to the present embodiment and the connection object 60 are separated from each other.

The connector 10 according to the present embodiment has a floating structure. The connector 10 allows relative movement of the connection object 60 connected thereto with respect to the circuit board CB 1. The connection object 60 connected to the connector 10 may move within a predetermined range with respect to the circuit board CB 1.

Figure 3:
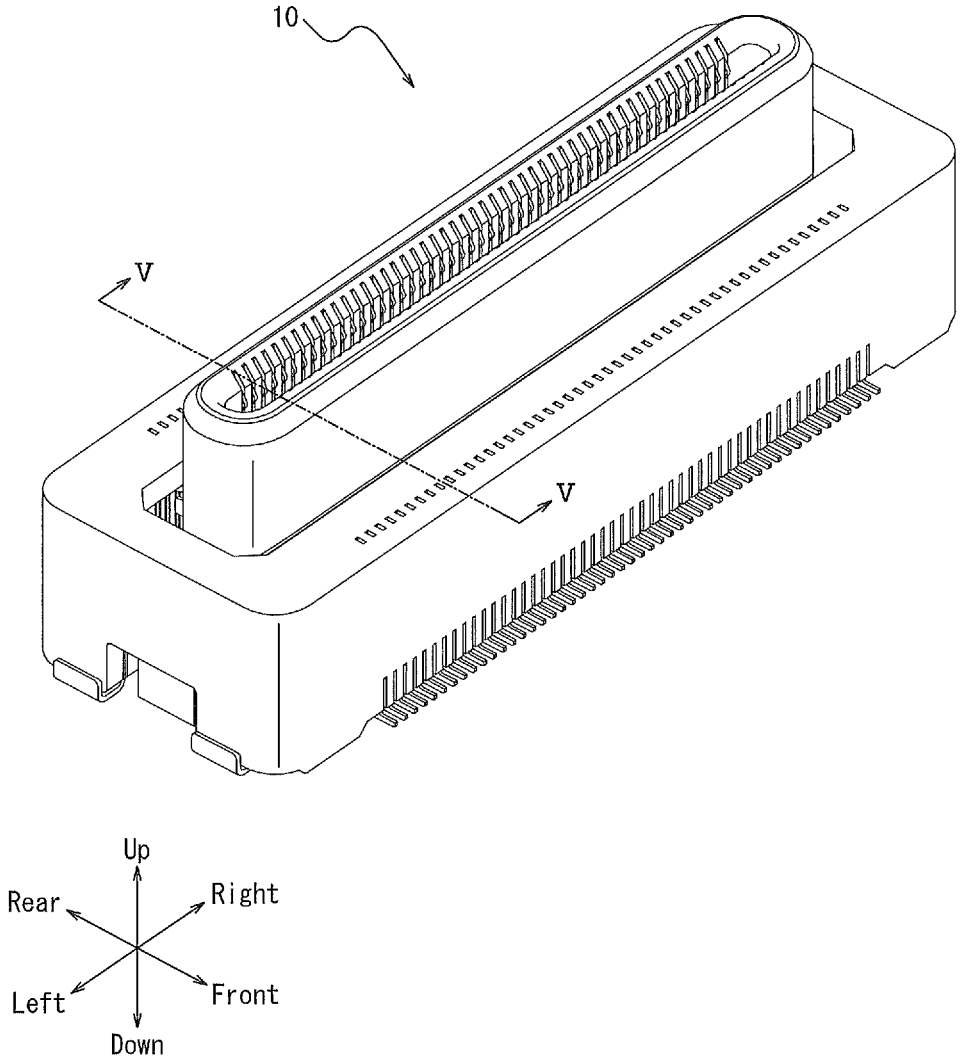
FIG. 3 is an external top perspective view illustrating the connector according to the embodiment.
Figure 4:
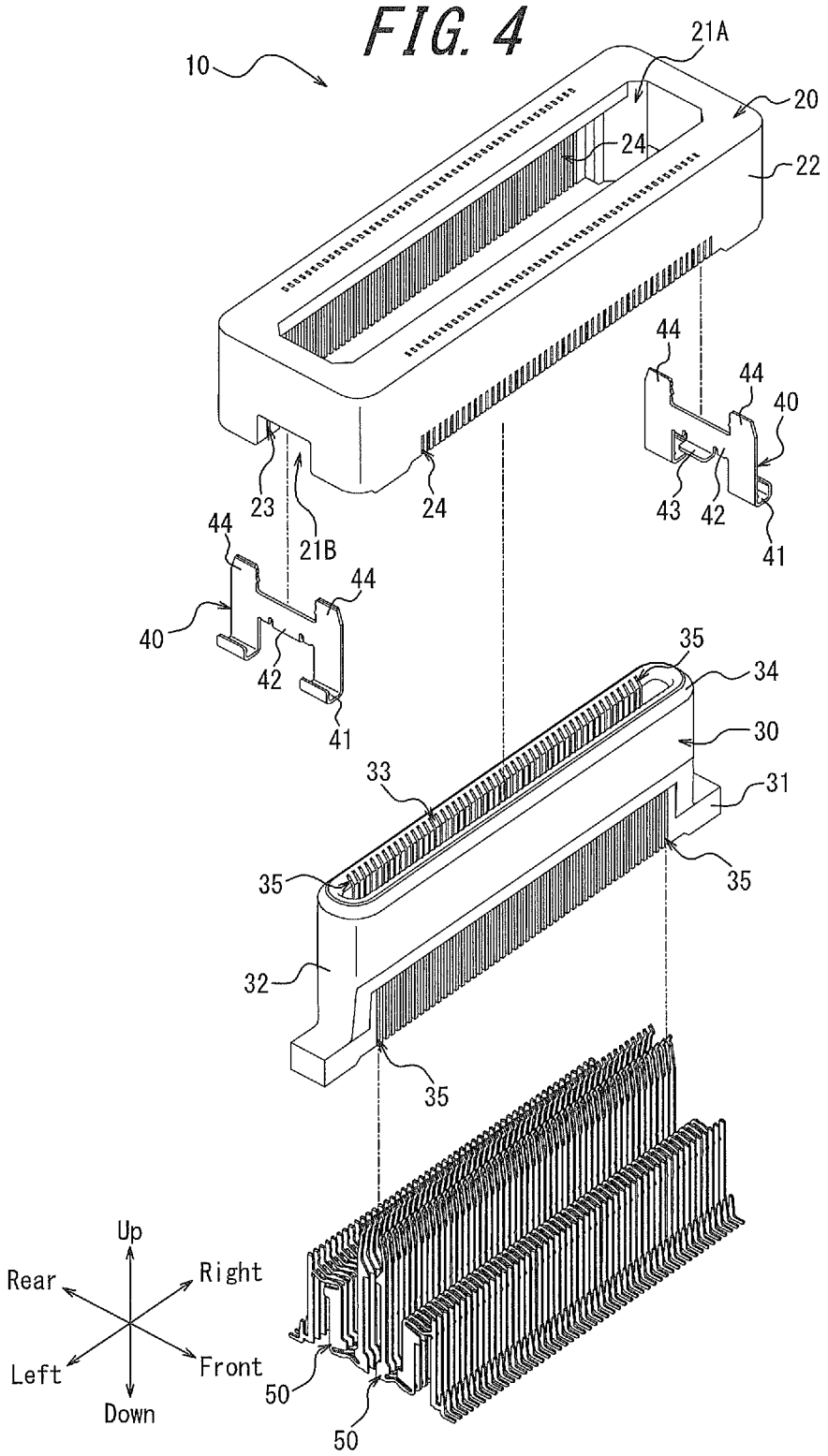
FIG. 4 is an exploded top perspective view of the connector of FIG. 3.
Figure 5:
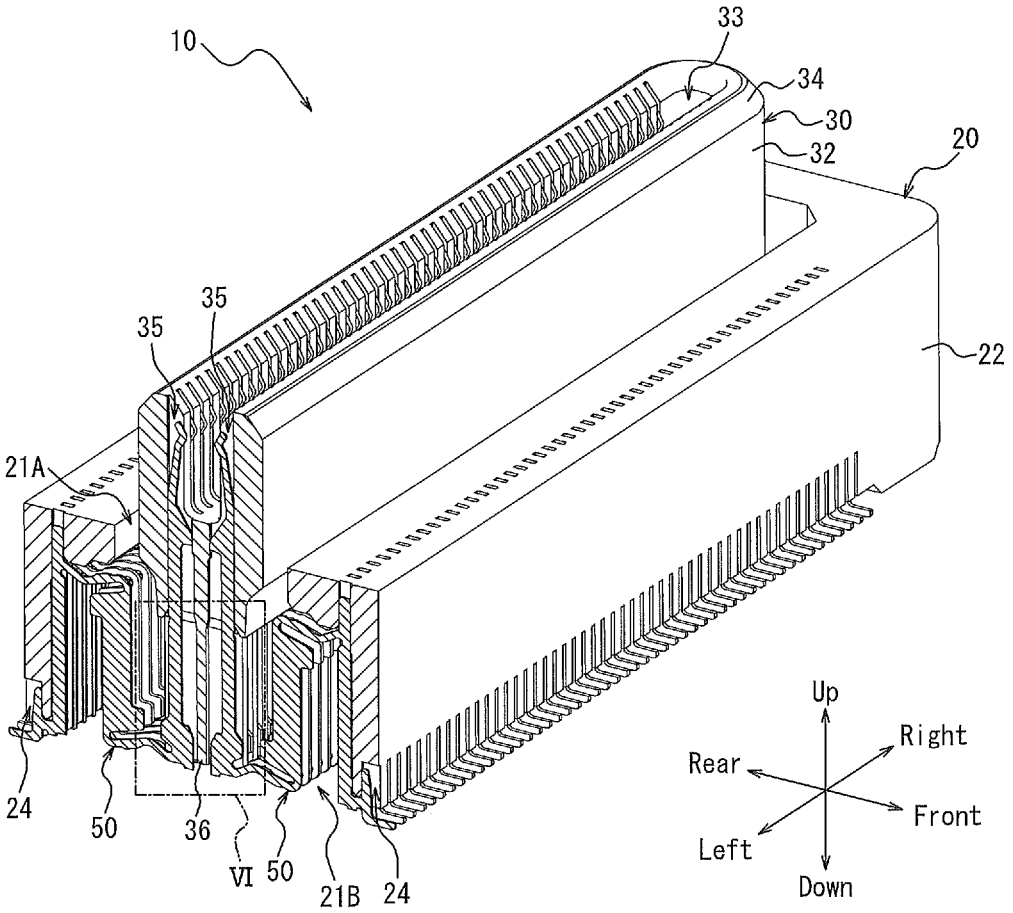
FIG. 5 is a cross-sectional perspective view taken from arrow V-V of FIG. 3.
Figure 6:
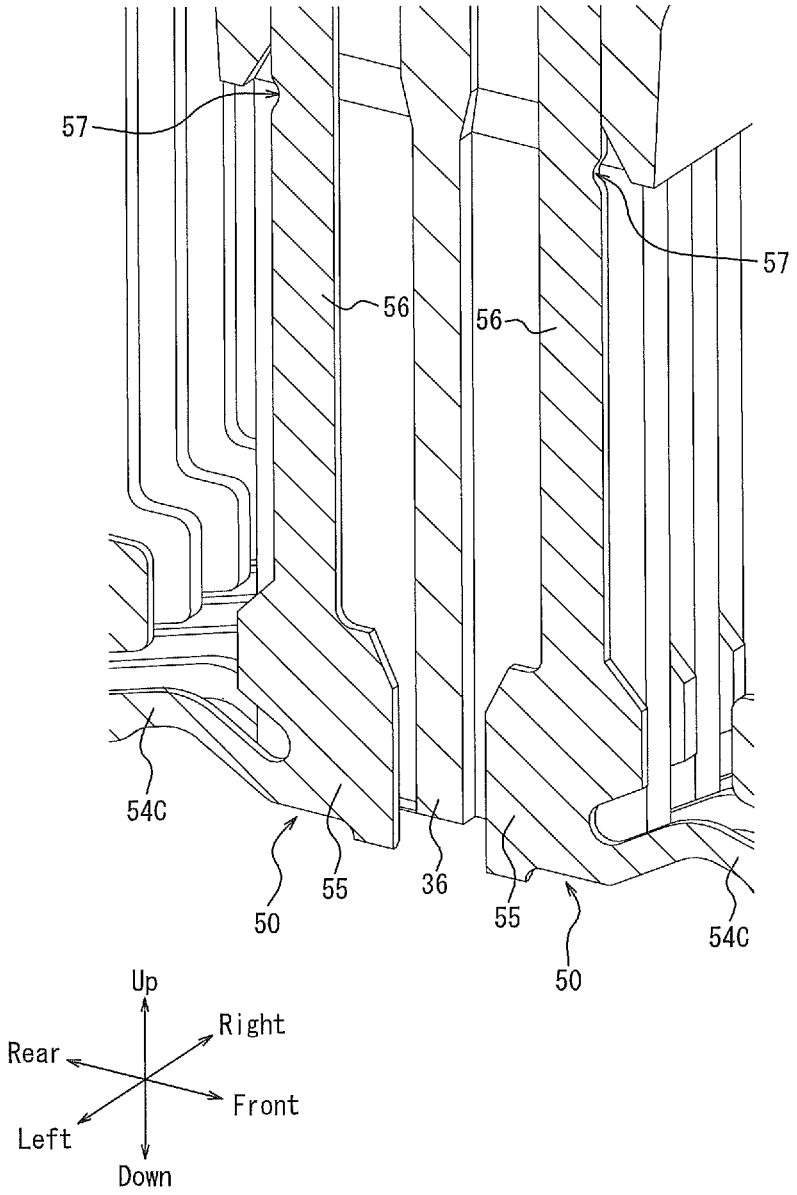
FIG. 6 is an enlarged view of a portion VI of FIG. 5.
Figure 7:
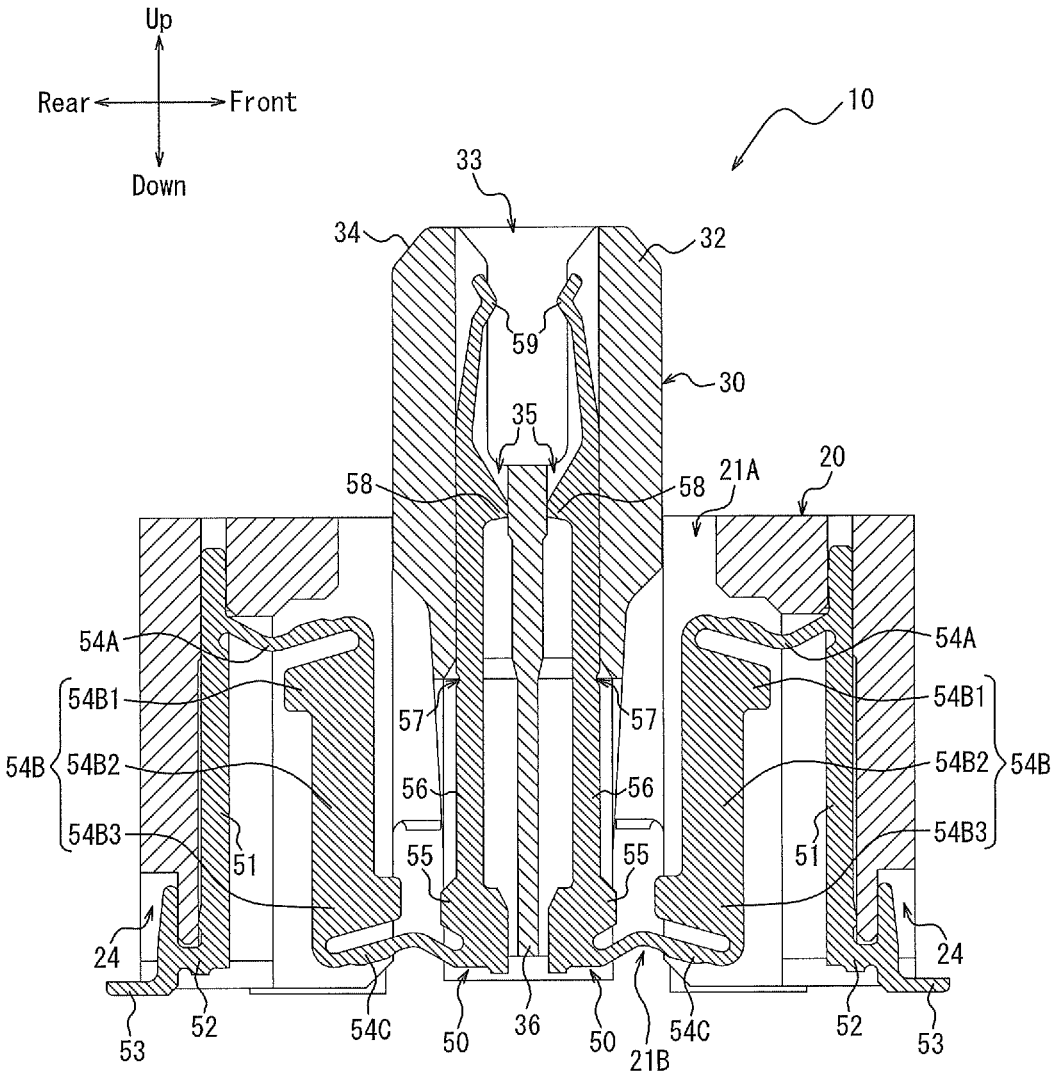
FIG. 7 is a cross-sectional view taken from arrow V-V of FIG. 3.
Figure 8:
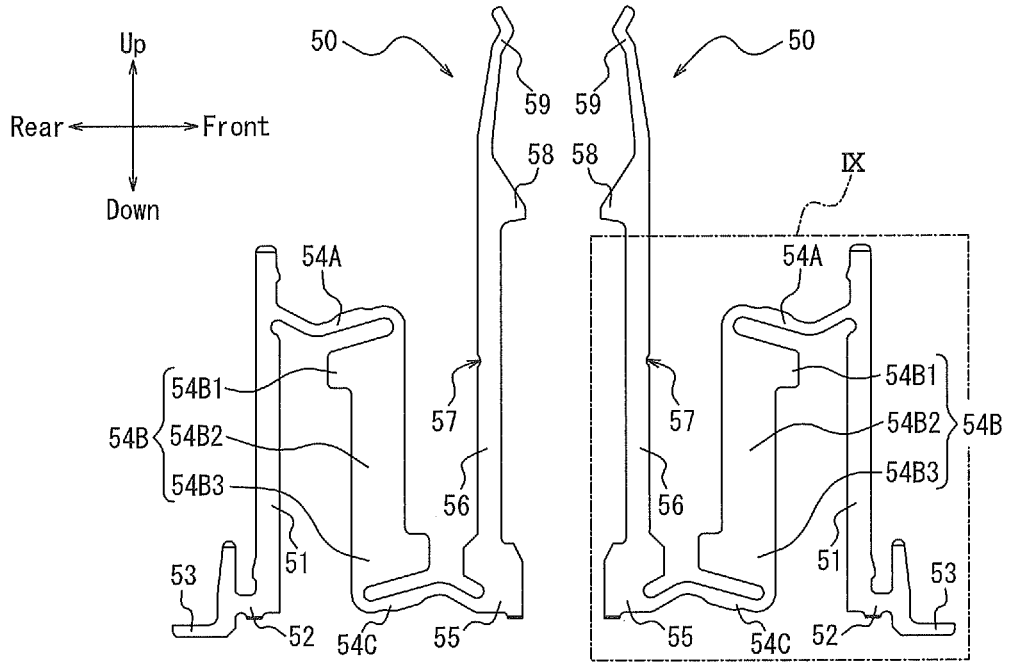
FIG. 8 is an elevation view of a pair of contacts.
Figure 9:
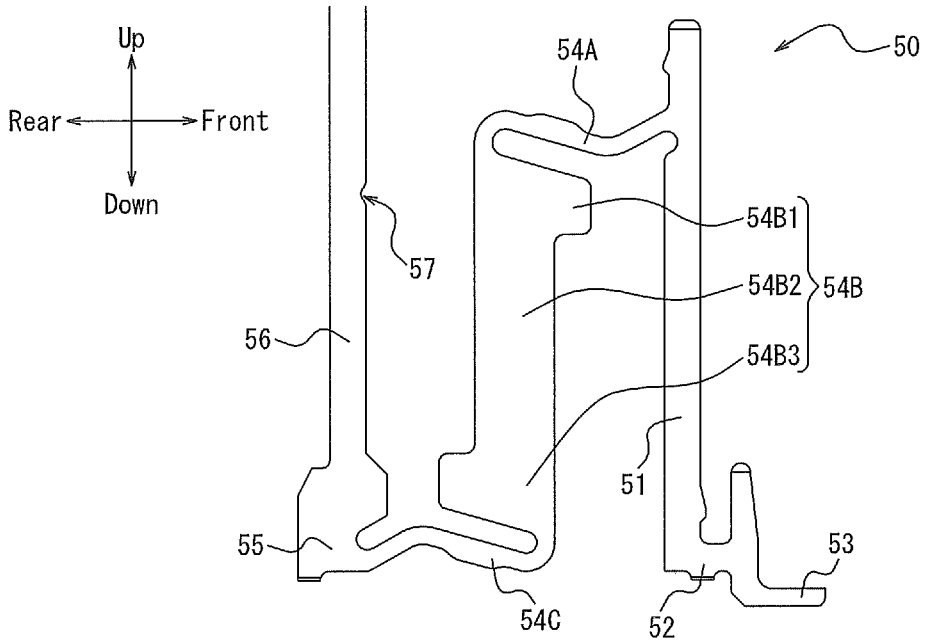
FIG. 9 is an enlarged view of a portion IX of FIG. 8.

FIG. 3 is an external top perspective view illustrating the connector 10 according to the present embodiment. FIG. 4 is an exploded top perspective view of the connector 10 of FIG. 3. FIG. 5 is a cross-sectional view taken from arrow V-V of FIG. 3. FIG. 6 is an enlarged view of a portion VI of FIG. 5. FIG. 7 is a cross-sectional view taken from arrow VI-VI of FIG. 3. FIG. 8 is an elevation view of a pair of contacts 50. FIG. 9 is an enlarged view of a portion IX of FIG. 8.

As illustrated in FIG. 4, the connector 10 includes, as main constituent elements, a first insulator 20, a second insulator 30, fitting brackets 40, and the contacts 50. The connector 10 is assembled in the following manner by way of example. The fitting brackets 40 are press-fitted into the first insulator 20 from below, and the second insulator 30 is arranged inside the first insulator 20 having the fitting brackets 40 press-fitted thereinto. The contact 50 is press-fitted into the first insulator 20 and the second insulator 30 from below.

A configuration of the connector 10 in a state in which the contacts 50 do not elastically deform will be described with reference mainly to FIG. 3 to FIG. 9.

As illustrated in FIG. 4 and FIG. 5, the first insulator 20 is a rectangular tubular member obtained by performing injection molding of a synthetic resin material having insulating and heat-resistant properties. The first insulator 20 is hollow and has an opening 21A and an opening 21B on its top surface and bottom surface, respectively. The first insulator 20 includes an outer peripheral wall 22 constituted of four side surfaces surrounding the space therein. The first insulator 20 includes fitting bracket attachment grooves 23 recessed upward along the up-down direction at left and right end portions of the outer peripheral wall 22 within the first insulator 20. The fitting brackets 40 are attached to the fitting bracket attachment grooves 23.

The first insulator 20 includes a plurality of contact attachment grooves 24 formed in the lower edge portions of the front and rear surfaces of the outer peripheral wall 22 across the bottom surface and the inner surface. The plurality of contacts 50 are attached to the respective one of the plurality of contact attachment grooves 24. The number of the contact attachment grooves 24 corresponds to the number of the contacts 50. The plurality of contact attachment grooves 24 are formed as recesses arranged side by side in the left-right direction. The contact attachment grooves 24 extend in the up-down direction on the inner surface of the first insulator 20.

The second insulator 30 is a member obtained by performing injection molding of a synthetic resin having insulating and heat-resistant properties. The second insulator 30 is formed in a substantially convex shape in an elevation view from the front direction. The second insulator 30 includes a bottom portion 31 that constitutes a lower portion, and a fitting projection 32 that is protruding upward from the bottom portion 31 and fitted into the connection object 60. The bottom portion 31 is longer than the fitting projection 32 in the left-right direction. That is, the left and right end portions of the bottom portion 31 protrude outward from the left and right end portions of the fitting projection 32. The second insulator 30 also includes a fitting recess 33 formed in a recessed manner on the top surface of the fitting projection 32. The second insulator 30 further includes a guiding portion 34 that extends on an upper edge portion of the fitting projection 32 and surrounds the fitting recess 33. The guiding portion 34 is formed as an inclined surface that is inclined obliquely inward in the upward direction.

The second insulator 30 includes a plurality of contact attachment grooves 35 formed side by side in the left-right direction. The plurality of contact attachment grooves 35 allow the respective plurality of contacts 50 to be fitted thereto. The number of the contact attachment grooves 35 corresponds to the number of contacts 50. The plurality of contact attachment grooves 35 extend in the up-down direction. The lower portions of the contact attachment grooves 35 are constituted of the lower portions of the front and rear surfaces of the second insulator 30 formed in a recessed manner. The central portions of the contact attachment grooves 35 are formed within the second insulator 30. The upper portions of the contact attachment grooves are constituted of the front and rear inner surfaces of the fitting recess 33 formed in the recessed manner.

The second insulator 30 includes a wall 36 that extends downward within the second insulator 30 from the bottom surface of the fitting recess 33. The wall 36 is located between a pair of contacts 50 which is arranged in the front-rear direction and attached to the second insulator 30. The wall 36 opposes each of the pair of contacts 50. The wall 36 has the largest width in its top portion. The middle portion of the wall 36 is formed to be narrower than the top portion. The lower portion of the wall 36 is formed to be narrower than the middle portion. The front and rear surfaces of the wall 36 constitute portions of the contact attachment grooves 35. The central portions of the contact attachment grooves 35 formed within the second insulator 30 are tapered with respect to the front-rear direction toward their tops, following the change in the widths of the central portion and the upper portion of the wall 36.

The fitting brackets 40 are obtained by molding thin plates made of any metallic material into a shape as illustrated in FIG. 4 by using a progressive die (stamping). The fitting brackets 40 are press-fitted into the respective fitting bracket attachment grooves 23 and located on the left and right end portions of the first insulator 20. Each of the fitting brackets 40 has a substantially H-shape in an elevation view in the left-right direction. The fitting brackets 40 include respective mounting portions 41 that extend outward in a substantially U-shape at the bottom edge in the front or rear surface of the fitting bracket 40. The fitting brackets 40 include respective connection portions 42 that extend in the front-rear direction at the substantially central portion of the fitting bracket 40 with respect to the up-down direction. The fitting brackets 40 include respective retainer portions 43 that extend inward in the left-right direction from the lower end portion of the substantially central portion of the connection portion 42. The retainer portions 43 inhibit the displacement of the second insulator 30 from the first insulator 20. Each of the fitting brackets 40 further include latches 44 that are formed in the upper end portion thereof on the front-rear sides and configured to latch to the first insulator 20.

Each of the contacts 50 is obtained by molding a thin plate made of, for example, a copper alloy having spring elasticity such as phosphor bronze, beryllium copper, or titanium copper, or a Corson type copper alloy into the shape as illustrated in FIG. 4 to FIG. 9 by using the progressive die (stamping). The contacts 50 are formed only by punching. The method for processing the contacts 50 is not limited thereto and may include a step of punching processing followed by bending in a thickness direction of the thin plate. The contacts 50 are made of a metallic material having a small elastic coefficient, so as to be largely deformed by elastic deformation. The surfaces of the contacts 50 are plated with gold or tin after nickel plate undercoating.

As illustrated in FIG. 4, the plurality of contacts 50 are arranged in the left-right direction. As illustrated in FIG. 7, the contacts 50 are fitted to the first insulator 20 and the second insulator 30. A pair of contacts 50 arranged in the same positions on the left and right sides is symmetrically formed and arranged along the front-rear direction as illustrated in FIG. 7 and FIG. 8. A pair of contacts 50 is formed and arranged so as to be substantially linearly symmetric with respect to a vertical axis passing through the center between the pair of contacts 50.

The contacts 50 include respective first bases 51 that are extending in the up-down direction and supported by the first insulator 20. The top end portions of the first bases 51 latch to the first insulator 20. The contacts 50 include respective latches 52 that are formed continuously with the lower end portion of the first base 51 and latch to the first insulator. The first bases 51 and the latches 52 are accommodated in the contact attachment grooves 24 of the first insulator 20. The contacts 50 include respective mounting portions 53 that extend outward in a substantially L-shape from the lower end portions of the outer surfaces of the latches 52.

As illustrated in FIG. 9, the contacts 50 include respective first elastic portions 54A that are elastically deformable and extend inward along the front-rear direction from the respective first bases 51. The first elastic portions 54A extend obliquely downward from the first bases 51 in the inward direction and then bend obliquely upward and linearly extend in that state. The first elastic portions 54A bend again downward at the inner end portion thereof and connected to the upper end portion of respective adjustment portions 54B. The first elastic portions 54A are formed to be narrower than the first bases 51. Thus, the first elastic portions 54A can adjust elastically displaced portions.

The contacts 50 include respective adjustment portions 54B that are formed continuously with the first elastic portions 54A. The adjustment portions 54B in their entirety are formed to be wider than the first elastic portions 54A, that is, to have larger cross-sections and thus have electric conductivities higher than those of the first elastic portions 54A. In a state in which the contacts 50 are not elastically deformed, the adjustment portions 54B extend in the up-down direction, that is, in the fitting direction to be fitted to the connection object 60.

The adjustment portions 54B include respective first adjustment portions 54B1, second adjustment portions 54B2, and third adjustment portions 54B3 that constitute upper portions, middle portions, and lower portions of the adjustment portions 54B, respectively. The upper end portions of the first adjustment portions 54B1 are connected to the first elastic portions 54A. The first adjustment portions 54B1 have cross-sectional areas larger than those of the first elastic portions 54A. The first adjustment portions 54B1 protrude from the second adjustment portions 54B2 by one step along the front-rear direction. The second adjustment portions 54B2 have cross-sectional areas smaller than those of the first adjustment portions 54B1 and larger than those of the first elastic portions 54A. For example, the second adjustment portions 54B2 are formed to be narrower than the first adjustment portions 54B1 and wider than the first elastic portions 54A, with respect to the front-rear direction. The third adjustment portions 54B3 have cross-sectional areas larger than those of the second adjustment portions 54B2. The third adjustment portions 54B3 protrude from the second adjustment portions 54B2 by one step along the front-rear direction. In the adjustment portions 54B, thus, each of the first adjustment portions 54B1 and the third adjustment portions 54B3 have high electric conductivities, and the second adjustment portions 54B2 have electric conductivities lower than those of the first adjustment portions 54B1 and the third adjustment portions 54B3. The first adjustment portions 54B1 and the third adjustment portions 54B3 are symmetrically formed. The first adjustment portions 54B1 and the third adjustment portions 54B3 may be formed to be substantially point-symmetrical with respect to the centers of the adjustment portions 54B.

The contacts 50 include respective second elastic portions 54C that are elastically deformable and extend from the bottom portions of the third adjustment portions 54B3 to the second insulator 30. The second elastic portions 54C bend obliquely upward from the bottom portions of the third adjustment portions 54B3 and then linearly extend. Then, the second elastic portions 54C bend again obliquely downward and connected to outer end portions of second bases 55, which will be described later. The second elastic portions 54C are formed to be narrower than the adjustment portions 51B, in a manner similar to the first elastic portions 54A. Thus, the second elastic portions 54C can adjust elastically displaced portions.

The first elastic portion 54A, the adjustment portion 54B, and the second elastic portion 54C are integrally formed in a substantially crank shape. The first elastic portions 54A, the adjustment portions 54B, and the second elastic portions 54C are located from a fitting side along the fitting direction in the stated order. The first elastic portions 54A and the second elastic portions 54C are symmetrically formed with respect to the adjustment portions 54B. The first elastic portions 54A and the second elastic portions 54C are substantially symmetrically formed with respect to the centers of the adjustment portions 54B.

The first elastic portions 54A and the second elastic portions 54C extend from the opposite end portions of the adjustment portion 54B. In particular, the first elastic portions 54A extend from the upper end portions of the first adjustment portion 54B1 on the inner side. On the other hand, the second elastic portions 54C extend from the lower end portions of the third adjustment portions 54B3 on the outer side. Thus, contact points between the first elastic portions 54A and the adjustment portions 54B and contact points between the second elastic portions 54C and the adjustment portions 54B are in symmetrical positions with respect to the centers of the adjustment portions 54B.

The contacts 50 include respective second bases 55 that are continuous with the second elastic portions 54C, as illustrated in FIG. 7 and FIG. 8. The second bases 55 are formed to be wider than the second elastic portion 54C and thus have higher rigidity. The contacts 50 include respective third elastic portions 56 that are elastically deformable and arranged along the inner wall of the second insulator 30. The third elastic portions 56 in a not elastically deformed state extend in the fitting direction to be fitted to the connection object 60, i.e., in the up-down direction. The third elastic portions 56 in their entirety oppose the wall 36 of the second insulator 30 formed on the inner side. The contacts 50 include respective cutouts 57 that are formed on the surfaces of the third elastic portions 56 and constitute bending points of the elastic deformations of the third elastic portions 56. The cutouts 57 are formed by cutting the outer surfaces of substantially central portions of the third elastic portions 56 in the front-rear direction. The contacts 50 include respective latches 58 that are formed continuously with upper portions of the third elastic portions 56 and configured to latch to the second insulator 30. The latches 58 are formed to be wider than the third elastic portions 56. The contacts 50 include respective elastic contact portions 59 that are formed continuously with upper portions of the latches 58 and come into contact with the contacts 90 of the connection object 60 when the connector 10 and the connection object 60 are fitted together. In the contacts 50, the elastic contact portions 59 are formed at, for example, distal ends continuous from the second adjustment portions 54B2 opposite to the first adjustment portion 54B1.

As illustrated in FIG. 7, the second bases 55, the third elastic portions 56, the cutouts 57, and the latches 58 are accommodated in the contact attachment grooves 35 of the second insulator 30. The second bases 55, the third elastic portions 56, and the latches 58, in their substantially entirety, oppose the wall 36 of the second insulator 30 formed on the inner side. As illustrated in FIG. 6, the second bases 55 connecting the second elastic portions 54C and the third elastic portions 56 together is arranged at a position facing the lower end portion of the wall 36.

As illustrated in FIG. 7, the second bases 55 and the lower half portions of the third elastic portions 56 are accommodated in the lower portions of the contact attachment grooves 35 formed as recesses on the front and rear surfaces of the second insulator 30. The upper half portions of the third elastic portions 56 and the latches 58 are accommodated in the central portions of the contact attachment grooves 35 formed by the inside of the second insulator 30. The cutouts 57 are formed on the surfaces of the third elastic portions 56 in the vicinity of boundaries between the lower portions and the central portions of the contact attachment grooves 35.

The elastic contact portions 59 are substantially accommodated in the upper portions of the contact attachment grooves 35 configured as recesses formed on the inner surfaces of the fitting recess 33 of the second insulator 30. The distal ends of the elastic contact portions 59 are out of the contact attachment grooves 35 and exposed in the fitting recess 33.

Figure 10:
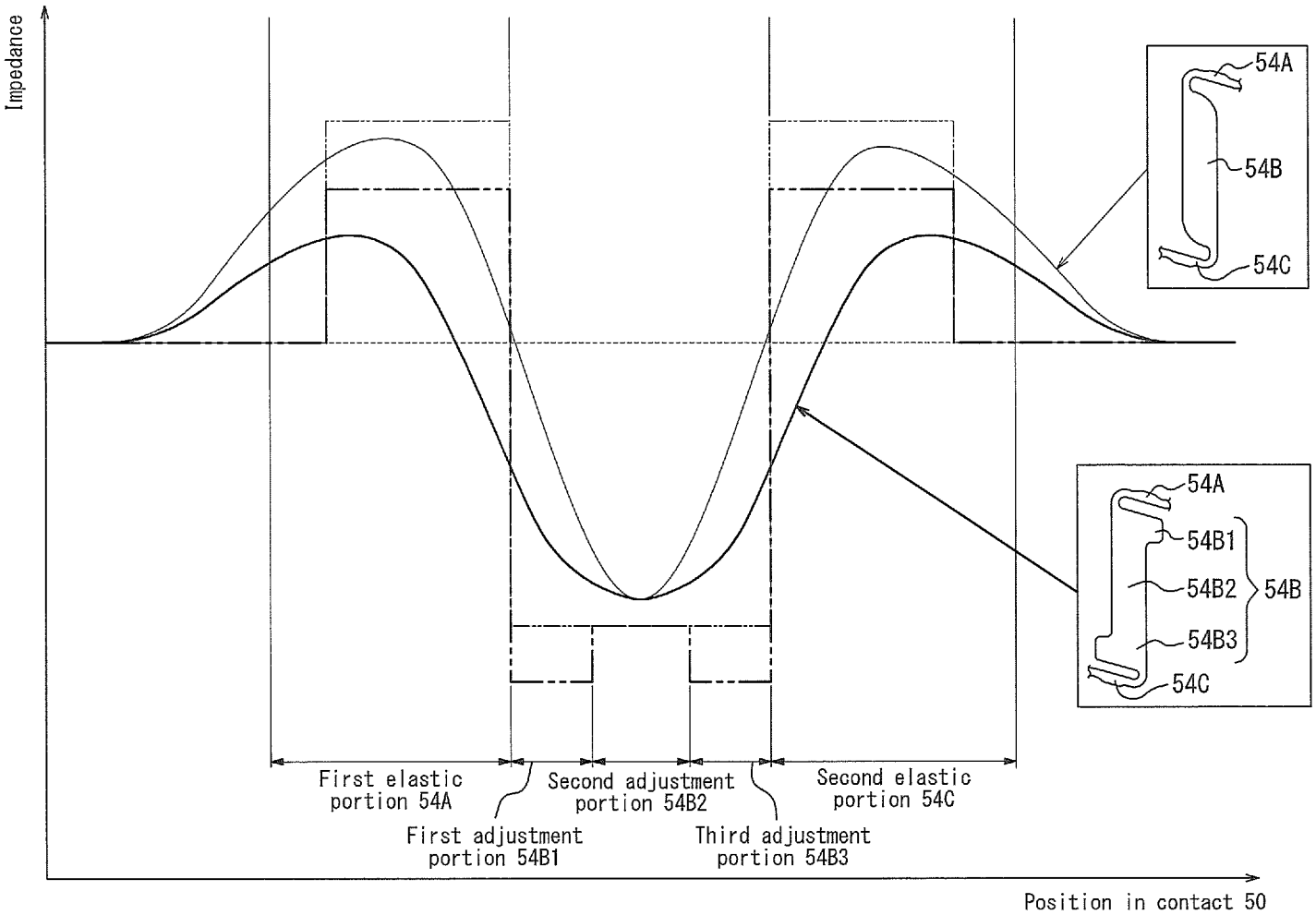
FIG. 10 is a schematic diagram illustrating an impedance change in a first elastic portion, an adjustment portion, and a second elastic portion.

FIG. 10 is a schematic diagram illustrating an impedance change in the first elastic portion 54A, the adjustment portion 54B, and the second elastic portion 54C of each of the contacts 50. A function of the adjustment portions 54B will be described with reference to FIG. 10. In FIG. 10, the vertical axis indicates a magnitude of the impedance. The horizontal axis indicates a position on the contacts 50. The solid lines represent a measured value of the impedance. The two-dot chain lines represent a theoretical value of the impedance. Each of the measured value and the theoretical value is indicated by a thick line and a thin line. The thick line indicates an impedance change when the adjustment portion 54B include respective three portions, i.e., the first adjustment portion 54B1, the second adjustment portion 54B2, and the third adjustment portion 54B3 in a manner similar to the contacts 50 according to the present embodiment. On the other hand, the thin line represents an impedance change in a temporary case where the adjustment portion 54B does not include the three portions and has a substantially uniform width. The broken line represents an ideal value of the impedance. First, for a comparison with the function of the adjustment portion 54B of each of the contacts 50 according to the present embodiment, the impedance change when the width of the adjustment portion 54B is substantially uniform will be described with reference to the thin line.

The impedance in the first elastic portion 54A, the adjustment portion 54B, and the second elastic portion 54C in their entirety is adjusted by the adjustment portion 54B. Theoretically, the impedance in each of the portions discretely changes according to widths, i.e., cross-sectional areas, of the portions. However, it is considered that the impedance changes continuously in fact. In each of the contacts 50, the first elastic portion 54A is formed to be narrow (has a narrow cross-sectional area) in order to obtain a large elastic deformation amount. Thus, the impedance adjusted to the ideal value increases in the first elastic portion 54A. Because the adjusting portion 54B formed continuously with the first elastic portion 54A is formed to be wide (has a large cross-sectional area), it is intended to cause fall of the impedance increased in the first elastic portion 54A below the ideal value in the adjusting portions 54B. Because the second elastic portion 54C formed to be continuous with the adjustment portion 54B is formed to be narrow (has a narrow cross-sectional area) in a manner similar to the first elastic portion 54A, the impedance being lower than the ideal value exceeds the ideal value again in the second elastic portion 54C. Thus, the adjustment portion 54B plays a role of canceling the impedance increase in the first elastic portion 54A and the second elastic portion 54C and bringing the impedance in its entirety close to the ideal value.

Next, the impedance change in the case where the adjustment portion 54B includes three portions in a manner similar to the contacts 50 according to the present embodiment will be described with reference to the thick line, as compared with the thin line. In each of the contacts 50 according to the present embodiment, as compared with each of the contacts 50 in the case where the adjustment portion 54B has a substantially uniform width, the impedance is further reduced in the upper portion of the first adjustment portion 549 by the first adjustment portion 54B1, which is formed to be wider than the second adjustment portion 54B2. Thus, it is intended that the impedance having been increased to be higher than the ideal value in the first elastic portion 54A quickly falls below the ideal value. In other words, an increase width of the impedance in the first elastic portion 54A is intentionally reduced. In each of the contacts 50, the impedance is increased in the central portion of the adjustment portion 54B, i.e., in the second adjustment portion 54B2, and the theoretical value of the impedance is approximately the same as the theoretical value represented by the thin line, by way of example. A minimum measured value of the impedance in the adjustment portion 54B is substantially the same as a minimum measured value of the impedance when the adjustment portion 54B has a substantially uniform width. This configuration inhibits an excessive reduction of the impedance in the second adjustment portion 54B2, i.e., an extreme deviation between the ideal value and the actual measured value. In each of the contacts 50, the impedance further decreases in the lower portion of the adjustment portion 54B due to the third adjustment portion 54B3 that is formed to be wide in a manner similar to the first adjustment portion 54B1. Thus, it is intended that the impedance being lower than the ideal value in the adjusting portion 54B exceeds the ideal value at a late timing in the second elastic portion 54C. In other words, the increase width of the impedance in the second elastic portion 54C is intentionally reduced. As described above, because the adjustment portion 54B includes the three portions, the adjustment portion 54B can cancel the impedance increase in the first elastic portion 54A and the second elastic portion 54C and bring the impedance close to the ideal value.

In the connector 10 structured as described above, the mounting portion 53 of the contact 50 is soldered to the circuit pattern formed on the mounting surface of the circuit board CB 1. The mounting portions 41 of the fitting brackets 40 are soldered to the ground pattern or the like formed on the mounting surface. In this way, the connector 10 is mounted on the circuit board CB 1. On the mounting surface of the circuit board CB 1, electronic components other than the connector 10 such as, for example, a CPU, a controller, a memory, and the like are mounted.

A configuration of the connection object 60 will be described with reference mainly to FIG. 11 and FIG. 12.

Figure 11:
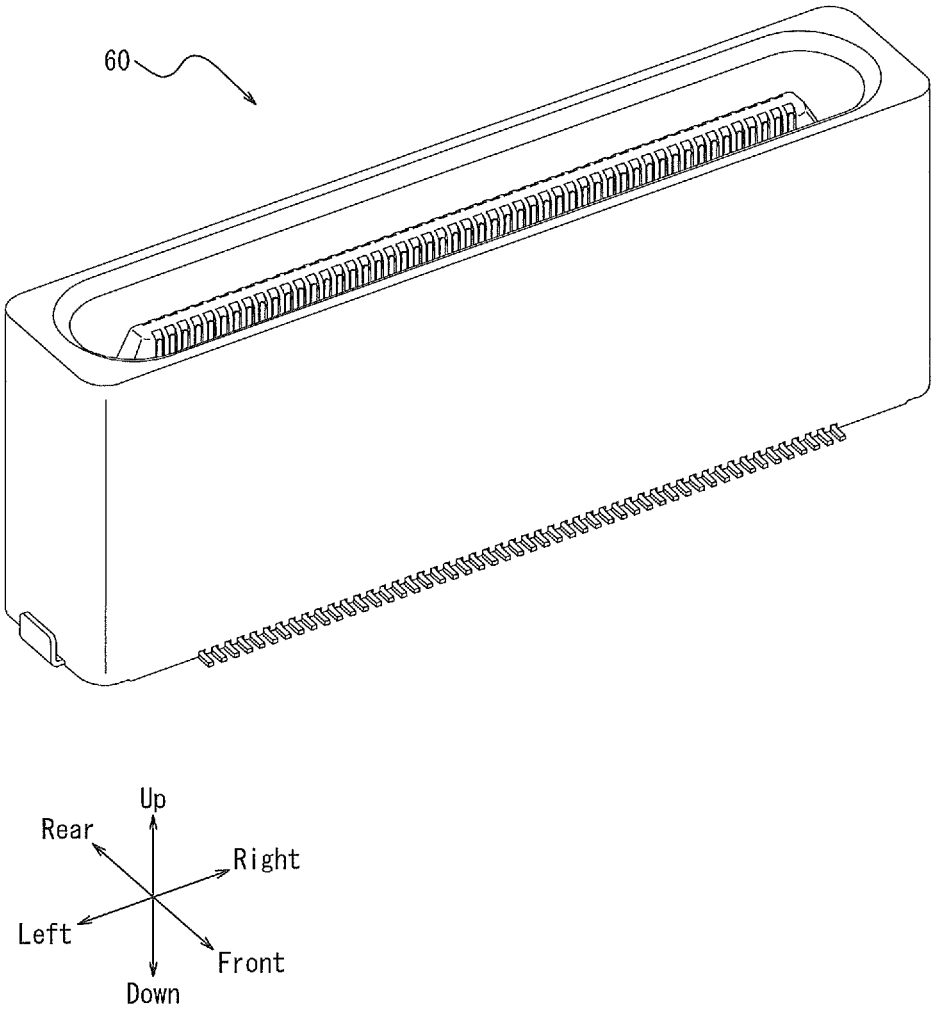
FIG. 11 is an exploded top perspective view of the connection object connected to the connector of FIG. 3.

FIG. 11 is an external top perspective view illustrating the connection object 60 to be connected to the connector 10 in FIG. 3. FIG. 12 is an exploded top perspective view of the connection object 60 of FIG. 11.

Figure 12:
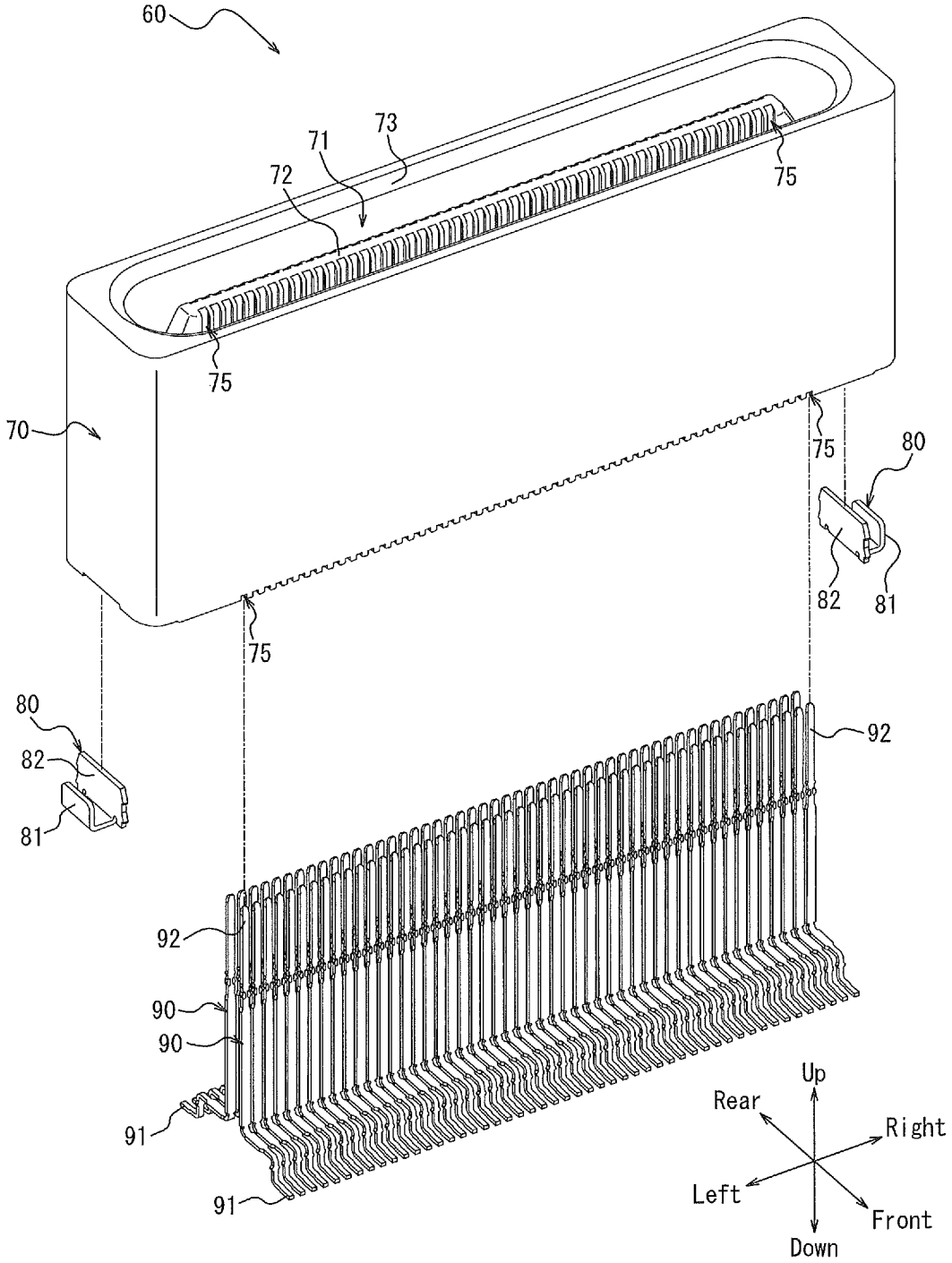
FIG. 12 is an exploded top perspective view of the connection object of FIG. 11.

As illustrated in FIG. 12, the connection object 60 includes an insulator 70, fitting brackets 80, and the contacts 90, as main constituent elements. The connection object 60 is assembled by press-fitting the fitting brackets 80 and the contacts 90 into the insulator 70 from under the insulator 70.

The insulator 70 is a rectangular tubular member obtained by performing injection molding of a synthetic resin material having insulating and heat-resistant properties. The insulator 70 includes a fitting recess 71 formed on the top surface of the insulator 70. The insulator 70 includes a fitting projection 72 formed within the fitting recess 71. The insulator 70 includes a guiding portion 73 surrounding the fitting recess 71 across the entire upper edge of the fitting recess 71. The guiding portion 73 is formed as an inclined surface inclined obliquely outwardly in the upward direction at the upper edge portion of the fitting recess 71. The insulator 70 includes fitting bracket attachment grooves 74 recessed in the insulator 70 along the up-down direction in both left and right end portions of the bottom surface (see FIG. 2). The fitting brackets 80 are attached to the fitting bracket attachment grooves 74.

The insulator 70 has a plurality of contact attachment grooves 75 formed on the front and rear sides of the bottom portion and the front and rear surfaces of the fitting projection 72. A plurality of contacts 90 are attached to the respective one of the plurality of contact attachment grooves 75. The number of the contact attachment grooves 75 corresponds to the number of contacts 90. The plurality of contact attachment grooves 75 are formed in a recessed manner and arranged side by side in the left-right direction.

Each of the fitting brackets 80 is obtained by molding a thin plate made of any metallic material into a shape as illustrated in FIG. 12 using a progressive die (stamping). The fitting brackets 80 are arranged in the left and right end portions of the insulator 70. Each of the fitting brackets 80 includes a mounting portion 81 that is formed in a substantially U-shape and extend outward. Each of the fitting brackets 80 includes a latch 82 that is formed continuously with the upper portion of the mounting portion 81 and latches to the insulator 70.

The contacts 90 are obtained by molding a thin plate made of, for example, a copper alloy having spring elasticity such as phosphor bronze, beryllium copper, or titanium copper, or a Corson type copper alloy into the shape as illustrated in FIG. 12 using a progressive die (stamping). The surfaces of the contacts 90 are plated with gold or tin after application of a nickel plate undercoat.

A plurality of contacts 90 are arranged along the left-right direction. Each of the contacts 90 includes a mounting portion 91 that is formed in a substantially L-shape and extends outward. Each of the contacts 90 includes a contact portion 92 that is formed in the upper end portion thereof and comes into contact with the elastic contact portion 59 of the contact 50 of the connector 10 when the connector 10 and the connection object 60 are fitted together.

In the connection object 60 having the above structure, the mounting portion 91 of each of the contacts 90 is soldered to the circuit pattern formed on the mounting surface of the circuit board CB 2. The mounting portion 81 of each of the fitting brackets 80 is soldered to the ground pattern or the like formed on the mounting surface. In this way, the connection object 60 is mounted on the circuit board CB 2. On the mounting surface of the circuit board CB 2, electronic components other than the connection object 60 including, for example, a camera module, a sensor, and the like are mounted.

An operation of the connector 10 having a floating structure when the connection object 60 is fitted to the connector 10 will be described.

Figure 13:
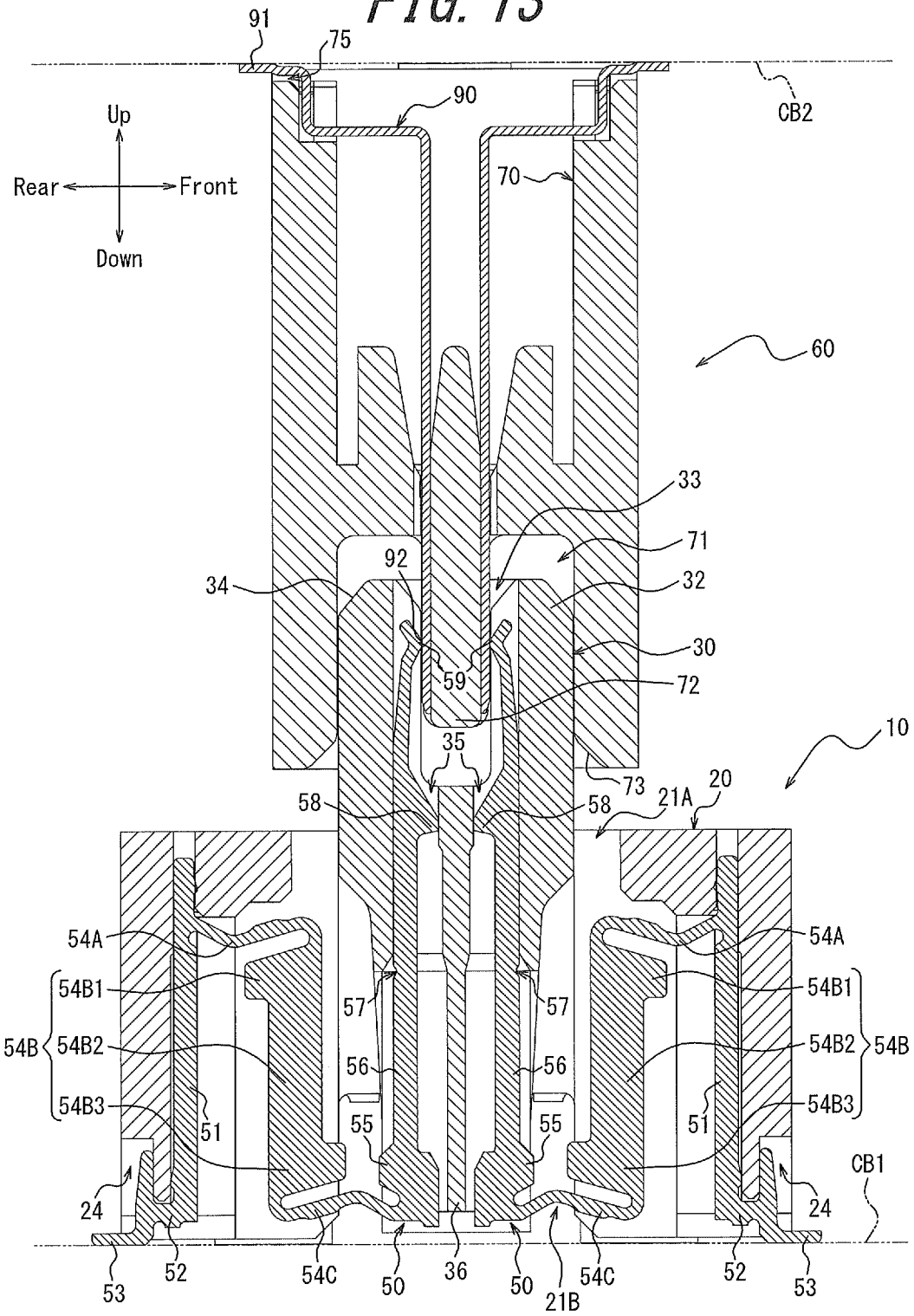
FIG. 13 is a cross-sectional view taken from arrow XIII-XIII of FIG. 1.

FIG. 13 is a cross-sectional view taken from arrow XIII-XIII of FIG. 1.

Each of the contacts 50 of the connector 10 supports the second insulator 30 in a state in which the second insulator 30 is spaced apart from the first insulator 20 and floating within the second insulator 30. At this time, the lower portion of the second insulator 30 is surrounded by the outer peripheral wall 22 of the first insulator 20. The upper portion of the second insulator 30 including the fitting recess 33 protrudes upward from the opening 21A of the first insulator 20.

When the mounting portions 53 of the contacts 50 are soldered to the circuit board CB 1, the first insulator 20 is fixed to the circuit board CB 1. The second insulator 30 is movable relative to the first insulator 20 fixed to the circuit board CB 1 when the first elastic portion 54A, the second elastic portion 54C, and the third elastic portion 56 of each of the contacts 50 are elastically deformed.

At this time, the peripheral edge portion of the opening 21A regulates excessive movement of the second insulator 30 with respect to the first insulator 20. When the second insulator 30 largely moves beyond the design value due to the elastic deformation of the contacts 50, the fitting projection 32 of the second insulator 30 comes into contact with the peripheral edge portion of the opening 21A. Thus, the second insulator 30 does not move further outward.

In a state in which the connection object 60 is flipped over relative to the connector 10 having such a floating structure, the connector 10 and the connection object 60 are brought to oppose each other in such a manner that the front-rear positions and the left-right positions of the connector 10 and the connection object 60 substantially meet one another. Then, the connection object 60 is moved downward. At this time, even when the connector 10 and the connection object 60 are displaced from each other in the front-rear direction and the right-left direction, the guiding portion 34 of the connector 10 and the guiding portion 73 of the connection object 60 come into contact with each other. Thus, the second insulator 30 moves relative to the first insulator 20 due to the floating structure of the connector 10. In particular, the fitting projection 32 of the connector 10 is guided into the fitting recess 71 of the connection object 60.

When the connection object 60 is further moved downward, the fitting projection 32 of the connector 10 and the fitting recess 71 of the connection object 60 are fitted together. At this time, the fitting recess 33 of the connector 10 and the fitting projection 72 of the connection object 60 are fitted together. The contacts 50 of the connector 10 and the contacts 90 of the connection object 60 come into contact with one another in a state in which the second insulator 30 of the connector 10 and the insulator 70 of the connection object 60 are fitted together. In particular, the elastic contact portions 59 of the contacts 50 and the contact portions 92 of the contacts 90 come into contact with one another. At this time, the distal end of the elastic contact portions 59 of the contacts 50 are slightly elastically deformed toward the outside and elastically displaced toward the inside of the contact attachment grooves 35.

In this way, the connector 10 and the connection object 60 are fully connected to each other. At this time, the circuit board CB 1 and the circuit board CB 2 are electrically connected to each other via the contacts 50 and the contacts 90.

In this state, the pair of elastic contact portions 59 of the contacts 50 clamps the pair of contacts 90 of the connection object 60 from both front and rear sides by applying inward elastic force along the front-rear direction. In response to the reaction of the pressing force to the contact 90 applied by the connection object 60 thus generated, the second insulator 30 receives a force acting in a removal direction, i.e., the upward direction, via the contacts 50 when the connection object 60 is removed from the connector 10. Accordingly, when the second insulator 30 is moved upward, the retainer portions 43 of the fitting brackets 40 press-fitted into the first insulator 20 illustrated in FIG. 4 inhibit displacement of the second insulator 30. The retainer portions 43 of the fitting brackets 40 press-fitted into the first insulator 20 are positioned directly above the left and right end portions of the bottom portion 31 of the second insulator 30 inside the first insulator 20. Thus, when the second insulator 30 is moved upward, the left and right end portions of the bottom portion 31 protruding outward come into contact with the retainer portions 43. Thus, a further upward movement of the second insulator 30 is inhibited.

Figure 14:
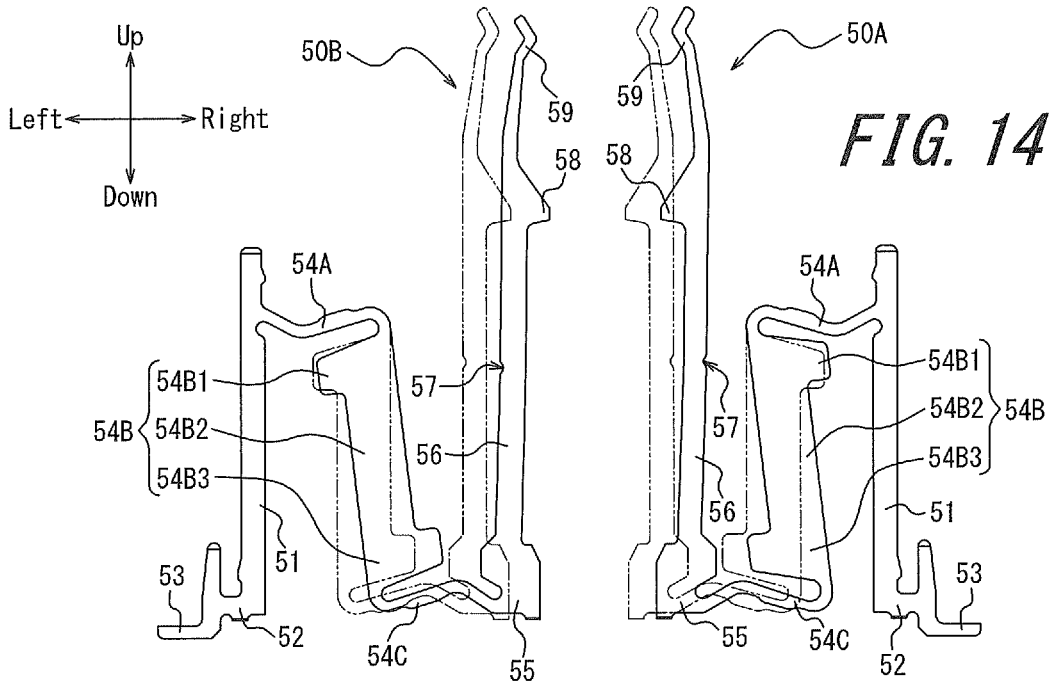
FIG. 14 is a schematic diagram illustrating a first example of elastic deformation of a pair of contacts.
Figure 15:
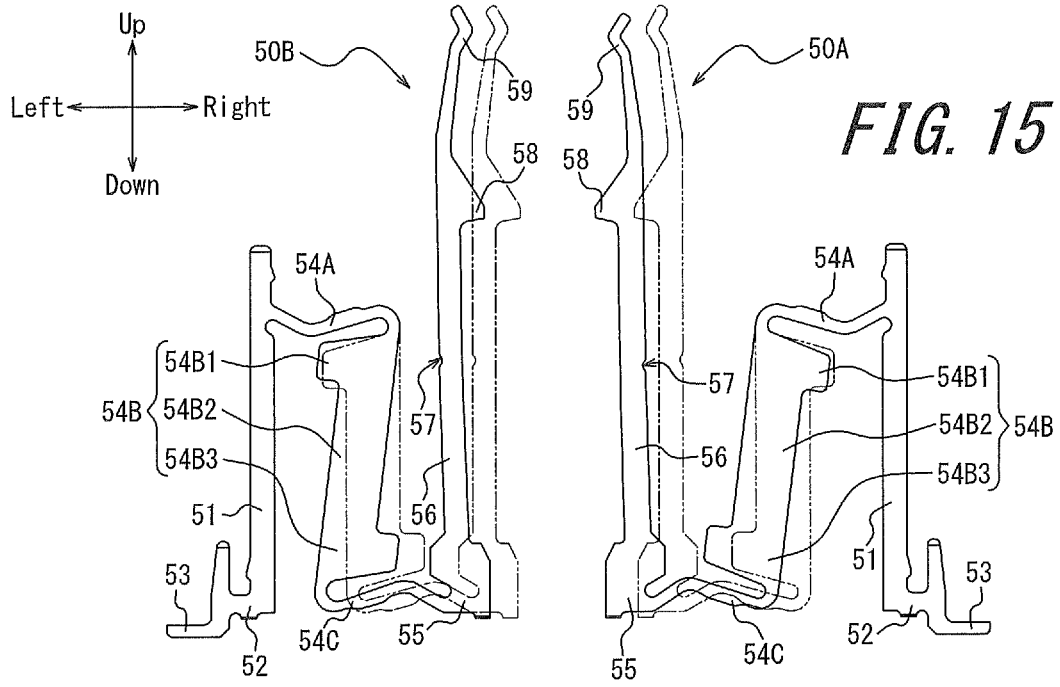
FIG. 15 is a schematic diagram illustrating a second example of elastic deformation of the pair of contacts.

FIG. 14 is a schematic diagram illustrating a first example of the elastic deformation of a pair of contacts 50. FIG. 15 is a schematic diagram illustrating a second example of the elastic deformation of the pair of contacts 50.

An operation performed by each constituent element when the pair of contacts 50 is elastically deformed will be described in detail with reference to FIG. 14 and FIG. 15. For the sake of simplicity of explanation, the contact 50 disposed on the right side in each of the drawings is referred to as a contact 50A, and the contact 50 disposed on the left side in each of the drawings will be described as a contact 50B. The two-dot chain lines in FIG. 14 and FIG. 15 indicate a state where the contacts 50A and 50B are not elastically deformed.

In FIG. 14, it is assumed that the second insulator 30 is moved to the right by some external factor, by way of example.

When the second insulator 30 is moved to the right, the latch 58 of the contact 50A is pushed to the right by the wall 36 of the second insulator 30. At this time, the third elastic portion 56 of the contact 50A is bent inward from the vicinity of the cutout 57. The third elastic portion 56 of the contact 50A is elastically deformed more inward in the lower portion from the vicinity of the cutout 57 than the upper portion. The relative position of the latch 58 of the contact 50A in contact with the wall 36 of the second insulator 30 with respect to the second insulator 30 is hardly changed. On the other hand, a relative position of the second base 55 of the contact 50A with respect to the second insulator 30 is changed inward.

When the third elastic portion 56 of the contact 50A is moved to the right, the second elastic portion 54C is elastically deformed, and a connection point between the second elastic portion 54C and the adjustment portion 54B is also moved to the right. On the other hand, a connection point between the first elastic portion 54A and the adjustment portion 54B is slightly moved in left-right direction. Thus, the first elastic portion 54A is elastically deformed in such a manner that a bent portion at the inner end portion is bent outward, and the adjustment portion 54B is inclined obliquely rightward from the upper portion to the lower portion.

When the second insulator 30 is moved to the right, the latch 58 of the contact 50B is pushed to the right by the inner wall of the second insulator 30. At this time, the third elastic portion 56 of the contact 50B is bent outward from the vicinity of the cutout 57. The third elastic portion 56 of the contact 50B is elastically deformed more outward in the lower portion from the vicinity of the cutout 57 than the upper portion. A relative position of the latch 58 of the contact 50B in contact with the inner wall of the contact attachment groove 35 with respect to the second insulator 30 is hardly changed. On the other hand, a relative position of the second base 55 of the contact 50B with respect to the second insulator 30 is changed outward.

When the third elastic portion 56 of the contact 50B is moved to the right, the second elastic portion 54C is elastically deformed, and the connection point between the second elastic portion 54C and the adjustment portion 54B is also moved to the right. On the other hand, the connection point between the first elastic portion 54A and the adjustment portion 54B is slightly moved in the left-right direction. Thus, the first elastic portion 54A is elastically deformed such that the bent portion at the inner end portion is bent inward, and the adjustment portion 54B is inclined obliquely rightward from the upper portion to the lower portion.

In FIG. 15, it is assumed that the second insulator 30 is moved to the left by some external factor, by way of example.

When the second insulator 30 is moved to the left, the latch 58 of the contact 50A is pushed to the left by the inner wall of the second insulator 30. At this time, the third elastic portion 56 of the contact 50A is bent outward from the vicinity of the cutout 57. The third elastic portion 56 of the contact 50A is elastically deformed more outward in the lower portion from the vicinity of the cutout 57 than the upper portion. A relative position of the latch 58 of the contact 50A in contact with the inner wall of the contact attachment groove 35 with respect to the second insulator 30 is hardly changed. On the other hand, a relative position of the second base 55 of the contact 50A with respect to the second insulator 30 is changed outward.

When the third elastic portion 56 of the contact 50A is moved to the left, the second elastic portion 54C is elastically deformed, and the connection point between the second elastic portion 54C and the adjustment portion 54B is also moved to the left. On the other hand, the connection point between the first elastic portion 54A and the adjustment portion 54B is slightly moved in the left-right direction. Thus, the first elastic portion 54A is elastically deformed such that the bent portion at the inner end portion is bent inward, and the adjustment portion 54B is inclined obliquely leftward from the upper portion to the lower portion.

When the second insulator 30 is moved to the left, the latch 58 of the contact 50B is pushed to the left by the wall 36 of the second insulator 30. At this time, the third elastic portion 56 of the contact 50B is bent inward from the vicinity of the cutout 57. The third elastic portion 56 of the contact 50B is elastically deformed more inward in the lower portion from the vicinity of the cutout 57 than the upper portion. A relative position of the latch 58 of the contact 50B in contact with the wall 36 of the second insulator 30 with respect to the second insulator 30 is hardly changed. On the other hand, a relative position of the second base 55 of the contact 50B with respect to the second insulator 30 is changed inward.

When the third elastic portion 56 of the contact 50B is moved to the left, the second elastic portion 54C is elastically deformed, and the connection point between the second elastic portion 54C and the adjustment portion 54B is also moved to the left. On the other hand, the connection point between the first elastic portion 54A and the adjustment portion 54B is slightly moved in the left-right direction. Thus, the first elastic portion 54A is elastically deformed such that the bent portion at the inner end portion is bent outward, and the adjustment portion 54B is inclined obliquely leftward from the upper portion to the lower portion.

The connector 10 according to the present embodiment configured as described above has good transmission characteristics for signal transmission. In the connector 10, because each of the contacts 50 includes the first adjusting portion 54B1 and the second adjusting portion 54B2, the impedance, i.e., the electric conductivity is adjusted according to the width, i.e., the cross-sectional area of each transmission path. For example, the electric conductivity of the first adjusting portion 54B1 is set to be higher than that of the first elastic portion 54A, and the electric conductivity of the second adjusting portion 54B2 is set to be lower than the first adjusting portion 54B1 and higher than the first elastic portion 54A. This brings the impedances of the first elastic portion 54A, the first adjustment portion 54B1, and the second adjustment portion 54B2 close to the ideal value. The connector 10 can contribute to impedance matching. In the connector 10, thus, a desired transmission characteristic can be obtained in large capacity and high-speed transmission, and have better transmission characteristic than that of the conventional electrical connectors those do not include the first adjustment portion 54B1 and the second adjustment portion 54B2.

In the connector 10, each of the contacts 50 further includes the third adjusting portion 54B3, such that the impedance, i.e., the electrical conductivity of the first elastic portion 54A, the adjusting portion 54B, and the second elastic portion 54C in their entirety is adjusted. For example, the electrical conductivity of the third adjusting portion 54B3 is set to be higher than that of the second adjusting portion 54B2 and the second elastic portion 54C. This brings the impedances of the first elastic portion 54A, the adjustment portion 54B, and the second elastic portion 54C close to the ideal value. The connector 10 can contribute to impedance matching. Thus, the connector 10 exerts the aforementioned effect more remarkably.

As will be described below, the connector 10 can realize an excellent floating structure in addition to excellent transmission characteristics for signal transmission as described above.

In the connector 10, because each of the contacts 50 further includes the second elastic portion 54C, the movement of the second insulator 30 relative to the first insulator 20 is further increased. Because the second elastic portion 54C is elastically deformed in addition to the elastic deformation of the first elastic portion 54A, the moving amount of the second insulator 30 relative to the first insulator 20 is increased.

In the connector 10, because each of the contacts 50 further includes the respective third elastic portions 56, the moving amount of the second insulator 30 relative to the first insulator 20 can be increased. Because the third elastic portion 56 is elastically deformed in addition to the elastic deformation of the first elastic portion 54A and the second elastic portion 54C, the moving amount of the second insulator 30 relative to the first insulator 20 is increased. In other words, because the connector 10 can allocate a part of the elastic deformation amount of the contact 50 necessary to obtain a predetermined moving amount to the third elastic portion 56, the elastic deformation amounts of the first elastic portion 54A and the elastic portion 54C can be reduced. This enables a reduction in a total length of the first elastic portion 54A, the adjustment portion 54B, and the second elastic portion 54C, and a reduction in the front-rear direction width of the connector 10. Accordingly, the connector 10 can contribute to the miniaturization of the second insulator 30 while securing the necessary moving amount of the second insulator 30.

Because the total length of the first elastic portion 54A, the adjustment portion 54B, and the second elastic portion 54C are reduced, the transmission characteristics of the connector 10 is further improved. Because of the reduction in a signal transmission path, the connector 10 can transmit a high frequency signal with less transmission loss.

Because the connector 10 includes the wall 36 at a position where the second insulator 30 opposes the second bases 55, the pair of contacts 50 arranged symmetrically in the front-rear direction in FIG. 7 can be inhibited from coming into contact with each other. As described above, the second bases 55 connecting the second elastic portions 54C and the third elastic portions 56 are moved, for example, in the front-rear direction of FIG. 7 in accordance with the elastic deformation of the second elastic portions 54C and the third elastic portions 56. At this time, in a case where the second insulator 30 does not include the wall 36, the second bases 55 of the pair of contacts 50 arranged in the front-rear direction possibly come into contact with each other, depending on their respective elastic deformation states. Because the wall 36 is formed, the connector 10 can inhibit the second bases 55 coining into contact with each other, and thus reducing electrically-induced troubles such as short circuiting and dynamically-induced troubles such as breakage. In other words, by virtue of the wall 36, the connector 10 can inhibit excessive elastic deformation of the third elastic portions 56. Even in a situation where the second bases 55 are moved in accordance with the elastic deformation of the second elastic portions 54C and the third elastic portions 56, the connector 10 can secure its reliability as a product.

In the connector 10, the first adjusting portions 54B1 protrude outward beyond the second adjusting portions 54B2 in the front-rear direction, and the third adjusting portions 54B3 protrude inward from the second adjusting portions 54B2 in the front-rear direction. This configuration inhibits first adjusting portions 54B1 and the third adjusting portions 54B3 from coming into contact with another portion of the contact 50 and the second insulator 30 when the contacts 50 are elastically deformed, as illustrated in FIG. 14 and FIG. 15. In the connector 10, accordingly, the protruding portions of the first adjusting portion 5491 and the third adjusting portion 54B3 do not interfere elastic deformation of the contacts 50, and a smooth movement of the second insulator 30 is realized, contributing to an excellent floating structure.

In the connector 10, because the first elastic portions 54A and the second elastic portions 54C extend from both fitting-direction ends of the adjustment portion 54B, necessary moving amounts of the adjustment portions 54B can be secured. Thus, the connector 10 can secure the necessary moving amount of the second insulator 30. In the connector 10, the integral formation of the first elastic portions 54A, the adjustment portions 54B, and the second elastic portions 54C in substantially crank shapes can contribute to a reduction in the front-rear length in FIG. 7 while exerting the aforementioned effect. For example, the first elastic portions 54A extend from the inner end portions of the upper edge portions of the adjustment portions 54B, and the second elastic portions 54C extend from the outer end portions of the lower edge portions of the adjustment portions 54B. Thus, the front-rear length of the connector 10 in its entirety is reduced. This configuration enables extension of the elastic deformation portions of the first elastic portions 54A and the second elastic portions 54C within the limited areas in the first insulator 20, and thus can realize an excellent floating structure.

Because the first elastic portions 54A, the adjustment portions 54B, and the second elastic portions 54C are arranged in the stated order from the fitting side along the fitting direction, the second bases 55 connected to the second elastic portion 54 C are located in the lowest position. This enables extension of the third elastic portion 56 and larger elastic deformation. Consequently, the moving amount of the second insulator 30 relative to the first insulator 20 is increased.

In the connector 10, because the contacts 50 further include the respective cutouts 57, the force applied to the latches 58 in contact with the inner wall of the second insulator 30 when the second insulator 30 is moved can be reduced. Similarly, the connector 10 can reduce the force applied to the elastic contact portions 59 located in the upper portions of the contact attachment grooves 35. The connector 10 can bend the third elastic portions 56 below the vicinity of the cutouts 57. In particular, in the third elastic portions 56 of in the connector 10, the elastic deformation amounts in the lower half portions are larger than those of the upper half portions between the lower end portions of the latches 58 and the vicinities of the cutouts 57. Thus, in a state in which the locking of the latches 58 to the second insulator 30 and the contact of the elastic contact portions 59 with the contact portions 92 are stable, the third elastic portions 56 can contribute to the movement of the second insulator 30 relative to the first insulator 20.

Because the contacts 50 are made of a metallic material having a small elastic coefficient, the necessary moving amount of the connector 10 can be secured in response to a small force applied to the second insulator 30. The second insulator 30 can smoothly move with respect to the first insulator 20. Thus, the connector 10 can easily accommodate the positional deviation when being fitted to the connection object 60. In the connector 10, each of the elastic portions of the contacts 50 absorbs vibrations caused by some external factor. This inhibits application of a large force to the mounting portion 53 and damage to a connection portion between the connector 10 and the circuit board CB 1. In this way, when the connector 10 is connected to the connection object 60, the connector 10 can maintain reliable connection.

Because the connector 10 includes the second bases 55 configured as wide portions of the contacts 50, the connector 10 can improve a product assembling property. Because the second bases 55 are formed to be wide, the rigidity of the second bases 55 is increased. This enables the contacts 50 to be stably inserted from below into the first insulator 20 and the second insulator 30 by an assembling machine or the like, with the second bases 55 serving as fulcrums.

The fitting brackets 40 are press-fitted into the first insulator 20, and the mounting portions 41 are soldered to the circuit board CB 1, whereby the fitting brackets 40 can stably fix the first insulator 20 to the circuit board CB 1. The fitting brackets 40 improve the mounting strength of the first insulator 20 on the circuit board CB 1.

It will be apparent to those who are skilled in the art that the present disclosure may be realized in forms other than the embodiment described above, without departing from the spirit and the fundamental characteristics of the present disclosure. Accordingly, the foregoing description is merely illustrative and not limiting in any manner. The scope of the present disclosure is defined by the appended claims, not by the foregoing description. Among all modifications, those within a range of the equivalent to the present disclosure shall be considered as being included in the present disclosure.

For example, the shape, the arrangement, and the number of each of the constituent elements described above are not limited to those in the above description and illustrated in the drawings. The shape, arrangement, and the number of each of the constituent elements may be appropriately determined to be able to realize its function. The assembly method of the connector 10 and the connection object 60 is not limited to that in the above description. Any assembly method of the connector 10 and the connection object 60 that enables the connector 10 and the connection object 60 to realize the respective functions may be employed. For example, the fitting brackets 40 or the contacts 50 may be integrally molded with the first insulator 20 or the second insulator 30 by insert molding, instead of press-fitting.

Although the connector 10 is described as a connector having a floating structure, this is not restrictive. The connector 10 may be any connector that includes the contacts 50 having the above-described configuration attached thereto. In this case, one insulator constituting the connector 10 may be used. For example, this insulator supports the first bases 51 of the contacts 50 and is fitted to the connection object 60.

It has been described that, in the adjustment portions 54B, the electrical conductivity is improved by the increase in the widths of the transmission paths, i.e., the cross-sectional areas of the transmission paths. However, a configuration of the adjustment portions 54B that improves the electrical conductivity is not limited thereto. The adjustment portions 54B may have any configuration that improves the electrical conductivity. For example, the adjustment portions 54B may be formed to be thicker than the first elastic portions 54A while maintaining the same width. For example, the adjustment portions 54B may be made of a material having a higher electric conductivity than that of the first elastic portions 54A while maintaining the same cross-sectional areas. For example, the surfaces of the adjusting portions 54B may be subjected to plating for improving electrical conductivity while maintaining the cross-sectional areas the same as those of the first elastic portions 54A.

It has been described that, in the adjustment portions 54B, the cross-sectional areas of the first adjustment sections 54B1, the second adjustment portions 54B2, and the third adjustment portions 54B3 are sequentially changed from the fitting side to adjust the electrical conductivity. However, the configuration of the adjustment portions 54B is not limited thereto. The adjusting portions 54B may have any configuration including a configuration having high electric conductivity, low electric conductivity, and high electric conductivity, in the stated order from the fitting side. For example, as described above, at least one of the width, the thickness, the cross-sectional area, the material, and the type of plating of each of the adjustment portion 54B may be changed to adjust the electrical conductivity thereof.

Figure 16A:
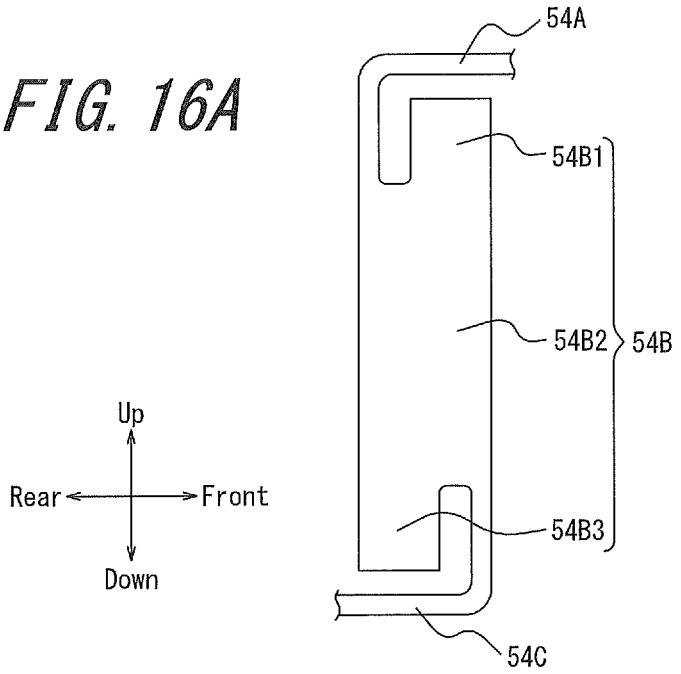
FIG. 16A is a schematic diagram illustrating a first example of a shape of an adjustment portion of each of the contacts.
Figure 16B:
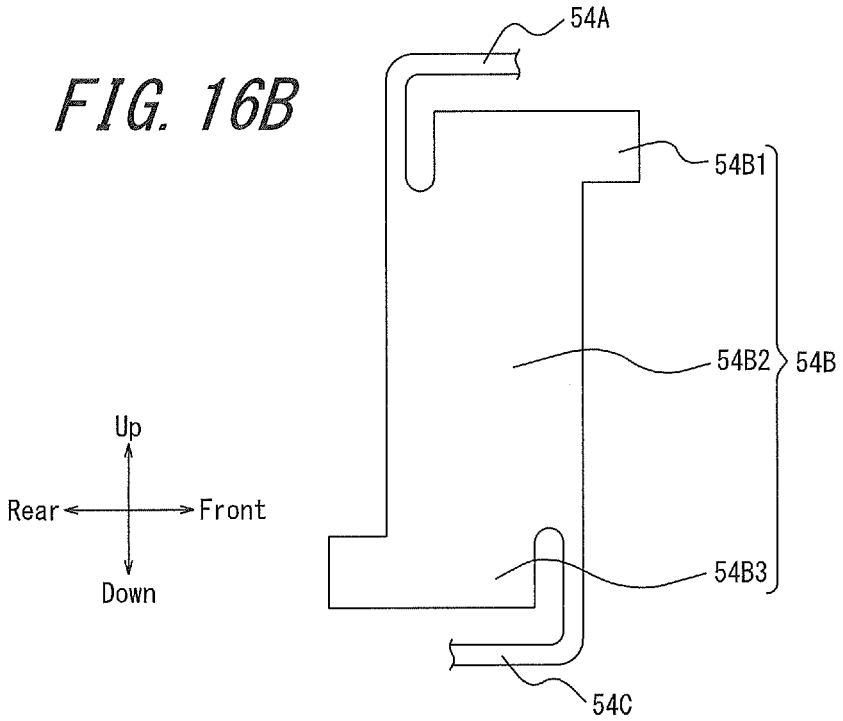
FIG. 16B is a schematic diagram illustrating a second example of the shape of the adjustment portion of each of the contacts.
Figure 16C:
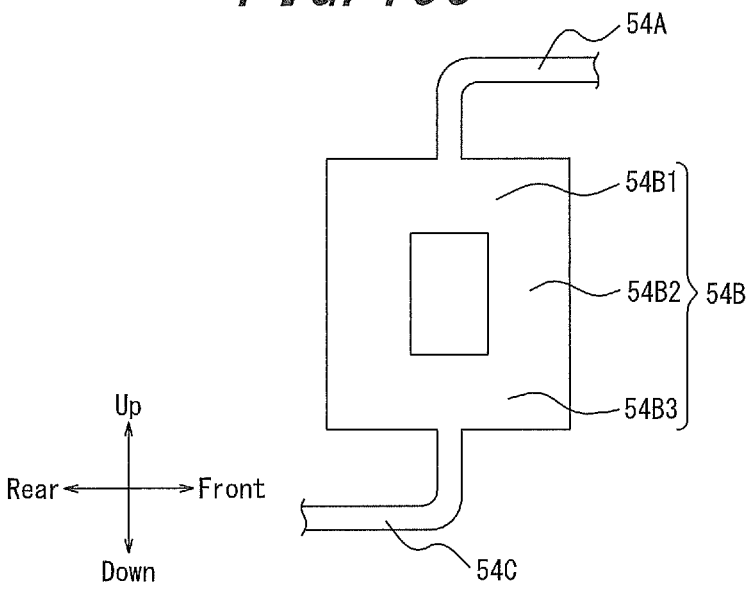
FIG. 16C is a schematic diagram illustrating a third example of the shape of the adjustment portion of each of the contacts.
Figure 16D:
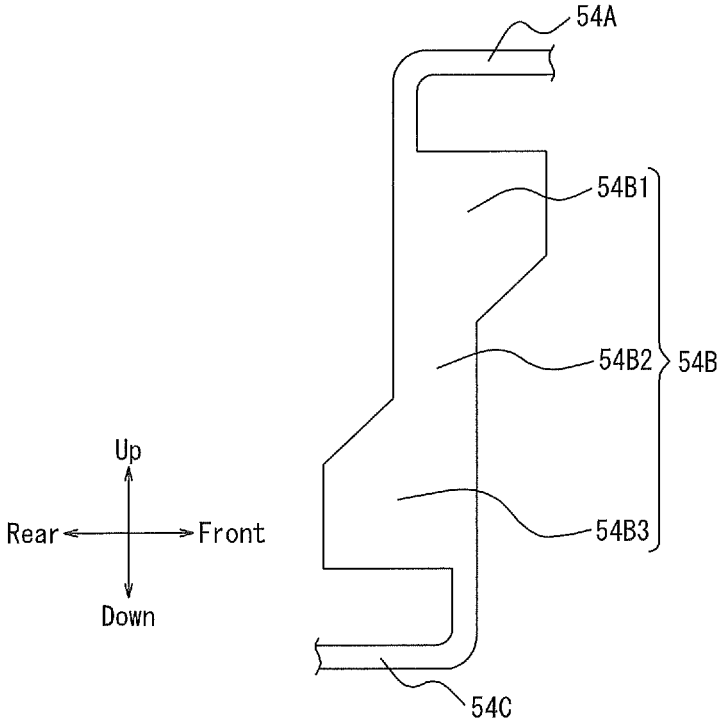
FIG. 16D is a schematic diagram illustrating a fourth example of the shape of the adjustment portion of each of the contacts.

FIG. 16A is a schematic diagram illustrating a first example of the shape of the adjustment portion 54B of each of the contacts 50. FIG. 16B is a schematic diagram illustrating a second example of the shape of the adjustment portion 54B of each of the contacts 50. FIG. 16C is a schematic diagram illustrating a third example of the shape of the adjustment portion 54B of each of the contacts 50. FIG. 16D is a schematic diagram illustrating a fourth example of the shape of the adjustment portion 54B of each of the contacts 50.

The shapes of the adjustment portions 54B are not limited to those illustrated in FIG. 9. The adjustment portions 54B may have any shape capable of realizing the function described above. For example, the adjustment portions 54B may have the shapes as illustrated in FIG. 16A to FIG. 16D. In the adjustment portion 54B illustrated in FIG. 16A, the first adjustment portion 54B 1 protrudes upward from the second adjustment portion 54B2, and the third adjustment portion 54B3 protrudes downward from the second adjustment portion 54B2. In the adjustment portion 54B illustrated in FIG. 16B, the first adjustment portion 54B1 protrudes upward from the second adjustment portion 54B2 and, simultaneously, protrudes by one step along the front-rear direction from the second adjustment portion 54B2. The third adjustment portion 54B3 protrudes downward from the second adjustment portion 54132 and, simultaneously, protrudes by one step along the front-rear direction from the second adjustment portion 54B2. In FIG. 16C, the adjustment portion 54B is formed in a rectangular shape in its entirety and has an opening at the center thereof. In the adjustment portion 54B illustrated in FIG. 16D, the adjustment portion 54B tapers from the first adjustment portion 54B1 to the second adjustment portion 54B2 and becomes thicker toward the third adjustment portion 54B3 from the second adjustment portion 54B2.

It has been described that the adjustment portions 54B extend in the fitting direction to be fitted to the connection object 60 when the first elastic portions 54A and the second elastic portions 54C are not elastically deformed, and the first elastic portions 54A and the second elastic portions 54C extend from the respective fitting-direction end portions of the adjustment portions 54B. However, this is not restrictive. The first elastic portions 54A, the adjustment portions 54B, and the second elastic portions 54C can be in any shape overall that can contribute to the miniaturization of the connector 10 while securing the necessary moving amount of the second insulator 30. For example, the adjustment portions 54B may extend being deviated from the fitting direction. For example, the first elastic portions 54A and the second elastic portions 54C may extend from the respective end portions of the adjustment portions 54B in the front-rear direction of FIG. 7. For example, the first elastic portions 54A and the second elastic portions 54C may have any shapes with more bent portions. For example, the first elastic portions 54A, the adjustment portions 54B, and the second elastic portions 54C may form a substantially U-shape overall, instead of a substantially crank-shape.

It has been described as illustrated in FIG. 8 that the first elastic portions 54A, the adjustment portions 54B, and the second elastic portions 54C are arranged in the stated order from the fitting side along the fitting direction. However, this is not restrictive. The first elastic portions 54A, the adjustment portions 54B, and the second elastic portions 54C may be arranged in the stated order from the opposite side when they can contribute to the miniaturization of the connector 10 while securing the necessary moving amount of the second insulator 30.

Although it has been described that the first elastic portions 54A and the second elastic portions 54C are formed to be narrower than the first bases 51, this is not restrictive. The first elastic portions 54A and the second elastic portions 54C may have any configuration capable of securing respective necessary elastic deformation amounts. For example, the first elastic portions 54A or the second elastic portions 54C may be made of a metal material having a smaller elastic modulus than the other portions of the contacts 50.

When the connector 10 can contribute to the miniaturization of the connector 10 while securing a necessary moving amount of the second insulator 30, the connector 10 does not need to include the second elastic portions 54C and the third elastic portions 56.

Although it has been described that the second bases 55 are formed to be wider than the second elastic portions 54C, this is not restrictive. The second bases 55 do not need to have wide widths when capable of maintaining the assembly property of the connector 10. Although it has been described that the wall 36 extends downward from the bottom surface of the fitting recess 33 within the contacts 50, this is not restrictive. For example, when the wall 36 can inhibit the contact between a pair of contacts 50, the wall 36 may be formed at a position facing the second bases 55 alone.

In a case where the third elastic portions 56 can contribute to the movement of the second insulator 30 in a state in which the engagement of the latches 58 and the contact of the elastic contact portions 59 are stable, the connector 10 does not need to include the cutouts 57.

Although the contacts 50 have been described as being made of a metal material having a small elastic coefficient, this is not restrictive. The contacts 50 may be made of any metal material having any elastic modulus that can secure the necessary elastic deformation amount.

Although the connection object 60 has been described as a receptacle connector connected to the circuit board CB 2, this is not restrictive. The connection object 60 may be any object other than a connector. For example, the connection object 60 may be an FPC, a flexible flat cable, a rigid board, or a card edge of any circuit board.

The connector 10 described above is mounted in an electronic device. The electronic device includes, for example, any in-vehicle device such as a camera, a radar, a drive recorder, or an ECU (engine control unit). The electronic device includes any in-vehicle device used in an in-vehicle system such as a GPS navigation system, an advanced driving support system, or a security system. The electronic device includes, for example, any information device such as a personal computer, a copy machine, a printer, a facsimile, or a multifunction machine. The electronic equipment also includes any industrial equipment.

Electronic devices as described above have excellent transmission characteristics for signal transmission. Because the floating structure of the connector 10 accommodates the positional displacement between the substrates in an excellent manner, the workability at the time of assembling the electronic devices is improved. The electronic devices can be easily manufactured. Because the connector 10 inhibits damages to the connection portion between the connector 10 and the circuit board CB 1, the reliability of the electronic device as a product is improved.

REFERENCE SIGNS LIST

10 connector
20 first insulator (insulator)
21A, 21B opening
22 outer peripheral wall
23 fitting bracket attachment groove
24 contact attachment groove
30 second insulator (insulator)
31 bottom portion
32 fitting projection
33 fitting recess
34 guiding portion
35 contact attachment groove
36 wall
40 fitting bracket
41 mounting portion
42 continuous portion
43 retainer portion
44 latch
50, 50A, 50B contact
51 first base
52 latch
53 mounting portion
54A first elastic portion
54B adjustment portion
54B1 first adjustment portion
54B2 second adjustment portion
54B3 third adjustment portion
54C second elastic portion
55 second base
56 third elastic portion
57 cutout
58 latch
59 elastic contact portion (contact portion)
60 connection object
70 insulator
71 fitting recess
72 fitting projection
73 guiding portion
74 fitting bracket attachment groove
75 contact attachment groove
80 fitting bracket
81 mounting portion
82 latch
90 contact
91 mounting portion
92 contact portion
CB 1, CB 2 circuit board

The invention claimed is:

1. A connector comprising:

a first insulator formed in a frame shape;

a second insulator to be fitted to a connection object, said second insulator being arranged inside said first insulator and being movable relative to said first insulator; and contacts, each of said contacts having a first base arranged along said first insulator and a second base arranged along said second insulator, wherein each of said contacts includes, between said first base and said second base, a first elastic portion that is elastically deformable, an adjustment portion and a second elastic portion that is elastically deformable, wherein said first elastic portion extends from said first base toward said second insulator, wherein said adjustment portion includes a first adjustment portion that is formed continuously with said first elastic portion and a second adjustment portion that is formed continuously with said first adjustment portion, wherein said first adjustment portion is wider in an extending direction of said first elastic portion than a width of said first elastic portion in a fitting direction between said second insulator and said connection object and a width of said second elastic portion in said fitting direction, and wherein said second adjustment portion is narrower in said extending direction than said first adjustment portion.

2. The connector according to claim 1, wherein said adjustment portion further includes a third adjustment portion that is formed continuously with said second adjustment portion, wherein said second adjustment portion is narrower in said extending direction than said third adjustment portion, and wherein said second elastic portion extends from said third adjustment portion toward said second insulator in said extending direction.

3. The connector according to claim 2, wherein said first adjustment portion, said second adjustment portion and said third adjustment portion are formed in order from a fitting side along said fitting direction.

4. The connector according to claim 1, wherein each of said contacts includes a third elastic portion that is elastically deformable, arranged along an inner wall of said second insulator, and extends in said fitting direction.

5. The connector according to claim 4, wherein said second base connects said second elastic portion and said third elastic portion together.

6. The connector according to claim 5, wherein said second insulator includes a wall opposing said second base.

7. The connector according to claim 4, further comprising:

a contact portion configured to electrically contact said connection object in a fitting state where said second insulator and said connection object are fitted together, wherein, in each of said contacts, said contact portion is formed at a tip of a portion continuous from said third elastic portion in said fitting direction.

8. An electronic device comprising a connector according to claim 1.

* * * * *